US008534201B2

(12) United States Patent
Sells

(10) Patent No.: US 8,534,201 B2
(45) Date of Patent: Sep. 17, 2013

(54) MULTIPLE TRACK RAILROAD SYSTEM

(76) Inventor: Gary L. Sells, South Bend, IN (US)

( * ) Notice: Subject to any disclaimer, the term of this patent is extended or adjusted under 35 U.S.C. 154(b) by 0 days.

(21) Appl. No.: 12/940,114

(22) Filed: Nov. 5, 2010

(65) Prior Publication Data

US 2011/0271467 A1 Nov. 10, 2011

Related U.S. Application Data

(62) Division of application No. 11/446,083, filed on Jun. 2, 2006, now Pat. No. 7,827,919.

(51) Int. Cl.
*B61F 1/00* (2006.01)

(52) U.S. Cl.
USPC ..... 105/176

(58) Field of Classification Search
USPC ..... 105/1.4, 26.05, 157.1, 158.1, 176, 105/238.1
See application file for complete search history.

(56) References Cited

U.S. PATENT DOCUMENTS

| | | | | |
|---|---|---|---|---|
| 722,436 | A | | 3/1903 | Suppan et al. |
| 751,798 | A | | 2/1904 | Lieb |
| 772,482 | A | | 10/1904 | Thomson |
| 953,116 | A | | 3/1910 | Bettendorf |
| 986,484 | A | | 3/1911 | Miller |
| 1,229,875 | A | | 6/1917 | Briggs |
| 1,392,523 | A | | 10/1921 | Pereire et al. |
| 1,550,239 | A | | 8/1925 | Billings et al. |
| 1,634,490 | A | | 7/1927 | Collis |
| 2,234,522 | A | | 3/1941 | Fleet et at. |
| 2,246,716 | A | | 6/1941 | Bottrill |
| 2,928,605 | A | | 3/1960 | Kirst |
| 3,078,814 | A | | 2/1963 | Candlin, Jr. et al. |
| 3,399,631 | A | | 9/1968 | Weber |
| 3,646,604 | A | | 2/1972 | Tack et al. |
| 3,716,146 | A | | 2/1973 | Altherr |
| 3,902,433 | A | | 9/1975 | Borchert et al. |
| 3,902,435 | A | | 9/1975 | Schuster |
| 4,794,032 | A | | 12/1988 | Fujii et al. |
| 4,962,861 | A | | 10/1990 | Wiebe |
| 5,201,152 | A | | 4/1993 | Heffner |
| 5,279,230 | A | | 1/1994 | Thomas et al. |
| 5,295,442 | A | * | 3/1994 | Carpenter ..... 105/176 |
| 5,802,981 | A | | 9/1998 | Kassab |
| RE35,961 | E | | 11/1998 | Wiebe |
| 6,449,536 | B1 | | 9/2002 | Brousseau |
| 7,827,919 | B2 | | 11/2010 | Sells |

* cited by examiner

*Primary Examiner* — R. J. McCarry, Jr.
(74) *Attorney, Agent, or Firm* — Faegre Baker Daniels, LLP

(57) ABSTRACT

A multiple track railroad system for use with two adjacent sets of parallel continuous tracks with the tracks having a distance therebetween and each set of tracks including two continuous rails having a distance therebetween. The railroad system includes an engine for pulling a train that has a set of wheels riding on at least two of the rails, and the engine has a width equal to at least one set of the tracks. The railroad system also includes at least one rail car connected to and propelled by the engine, wherein the rail car spans and extends beyond the outer rails of both sets of tracks. The railroad system further includes at least four car-trucks supporting the rail car, with two of the car-trucks on each of the sets of tracks, and each car-truck includes at least four wheels, with two wheels each riding on opposing rails of a set of the tracks; and trundle carrier assemblies, one each mounted to a bolster on each of the car-trucks with the upper end of the carrier assemblies being attached to the rail car to permit the car-trucks to move vertically or horizontally transverse on the tracks relative to the rail car to accommodate variations in the elevation or distance between the tracks.

13 Claims, 23 Drawing Sheets

MULTIPLE TRACK RAILROAD SYSTEM

This application claims the benefit of U.S. patent application Ser. No. 11/446,083 filed Jun. 2, 2006, the complete disclosure of which is hereby expressly incorporated by reference.

BACKGROUND OF THE INVENTION

The present invention relates to a railroad system and, in particular, to a railroad system that utilizes multiple tracks.

The railroad industry has a long history of being one of the most cost-effective means to transport goods across landmasses. Most railroad systems employ two sets of parallel railroad tracks. Each set of tracks consists of a pair of parallel rails that are set apart at a fixed distance of approximately five feet. The rails in a set are connected to one another by railroad ties, which are typically rectangular lengths of treated wood placed beneath the rails and transverse thereto. The rails are affixed to the ties using steel spikes. The two sets of tracks are laid parallel to one another at approximately the same elevation so that the inner rails of each set are at a distance of approximately 8½ feet from one another.

The tracks are typically utilized by trains, wherein one set of tracks is used for trains traveling in one direction and the other set of rails is used for trains traveling in the opposite direction. Trains typically consist of one or more powered engines coupled together at the front of the train pulling a'multiplicity of cars, which may include box cars, tanker cars, flatbed cars, bin cars, passenger cars, etc., that are aligned in a single row and coupled together. Each car rides on a set of car-trucks that include a plurality of wheels riding on and rolling along one of the sets of tracks.

Such trains can carry a significant load of cargo; however, it would be possible to carry even more cargo in a more cost-effective manner if a multiple track railroad system were employed having trains that span and utilize both sets of tracks. Of course, specific technical features (such as a means to compensate for adjustment in the distance or heights between the sets of parallel tracks) not required on trains that run on a single set of tracks will be required for trains that run on both sets of tracks.

U.S. Pat. No. 722,436 to Suppan et al. discloses a truck for transport of ships. The truck disclosed by Suppan is supported on and runs on pairs of wheels running on two sets of parallel tracks.

U.S. Pat. No. 772,482 to Thomson discloses a tank for carrying a boat. The tank is supported by wheels running on a rail track. The embodiment depicted shows the rail tracks having four longitudinal rails and a central rail standing higher than the other rails and adapted to guide the tank and wheel frames transversely.

U.S. Pat. No. 1,392,523 to Pereire et al. discloses a large capacity railway carriage mounted on a plurality of bogie trucks and designed to travel on a plurality of railroad tracks. In one embodiment, eight bogie trucks are used with four bogie trucks on each of two sets of tracks.

U.S. Pat. No. 1,634,490 to Collis discloses a railway train with cars of such width that two lines of track are required for their support (i.e., lines of tracks with two rails each where normally one line is for a train traveling in one direction and the other line is for a train traveling in the opposite direction). The car disclosed by Collis has a width of twenty-one feet and four inches, instead of the customary eight feet and nine inches. For passengers, the car includes six longitudinal rows of seats instead of the customary two rows of seats.

U.S. Pat. No. 2,234,522 to Fleet et al. discloses a rail car spanning two sets of tracks for carrying and launching an airplane. Several embodiments are discussed by Fleet et al. for the purpose of accommodating deviations in the distance between the tracks. One embodiment includes a connecting rod and lever arm connecting tension links in side-by-side rail trucks. In another embodiment, the tracks are connected by a pair of connecting rods pivotally connected to a compensating lever.

U.S. Pat. No. 2,246,716 to Bottrill discloses a mobile landing platform for an airplane. The landing platform is supported by two automotive railway cars that are attached and secured to one another with cross beams so that the cars are side by side on a double-track railroad.

U.S. Pat. No. 3,902,433 to Borchert et al. discloses a large volume railway car for movement on a four-rail track in which each end of the railway car is provided with two parallel interconnected bogies having two or more axles. The bogie pairs are interconnected to one another by a common bridge. The wheel sets of the bogies have wheel rims arranged on the outer sides of each pair of tracks on which the bogie is riding to keep the bogies on the track rails.

U.S. Pat. No. 5,295,442 to Carpenter discloses a multiple track railroad system having a greater than standard width to span adjacent parallel tracks. The railroad track system in Carpenter is designed to ride on standard wheel trucks on each of the parallel tracks. Carpenter discloses laterally spaced apart and coupled conventional engines to pull the cars, and an interconnection between the laterally spaced locomotives is provided to enable the train to be operated by a single crew in the cab of one locomotive. Carpenter also discloses a single locomotive spanning two adjacent parallel tracks, and couplings are provided to enable conventional cars to be coupled to wider cars.

U.S. Pat. No. 5,802,981 to Kassab discloses a railway vehicle having 12 wheel and axle assemblies grouped into six two-axle assemblies. Three truck assemblies are mounted on each of two span bolsters, which in turn are mounted on opposite ends of the railway vehicle. The truck assemblies are rotatably mounted to the span bolster and the span bolster is rotatably mounted to the railway vehicle.

SUMMARY OF THE INVENTION

In one embodiment of the present invention, a multiple track railroad system is provided for use with two adjacent sets of parallel continuous tracks with the tracks having a distance therebetween and each set of tracks including two continuous rails having a distance therebetween. The railroad system includes an engine for pulling a train that has a set of wheels riding on at least two of the rails, and the engine has a width equal to at least one set of the tracks. The railroad system also includes at least one rail car connected to and propelled by the engine, wherein the rail car spans and extends beyond the outer rails of both sets of tracks. The railroad system further includes at least four car-trucks supporting the rail car, with two of the car-trucks on each of the sets of tracks, and each car-truck includes at least four wheels, with two wheels each riding on opposing rails of a set of the tracks; and trundle carrier assemblies, one each mounted to a bolster on each of the car-trucks with the upper end of the carrier assemblies being attached to the rail car to permit the car-trucks to move vertically or horizontally transverse on the tracks relative to the rail car to accommodate variations in the elevation or distance between the tracks.

The trundle carrier assemblies may include a trundle body and a trundle pin inserted in and movable relative to the trundle body. The trundle bodies may include a cavity open to a surface thereof. The trundle carrier assembly may include a lower trundle socket mounted to the bolster, and the trundle stud pin may be attached to and extend from the lower trundle socket.

The multiple track railroad system may further include a trundle ball interposed between the trundle body and the trundle stud pin in the cavity. The trundle ball may include a base and an elliptical extension. The trundle ball may also include a recess extending from the base into the elliptical extension for receipt of the trundle stud pin. The trundle stud pin can fit snugly in the recess of the trundle ball; however, there is sufficient clearance between the elliptical extension and the walls of the cavity of the trundle body to permit relative movement between the trundle ball and the trundle body. The cavity of the trundle body may include an elliptical portion having a diameter greater than the diameter of the cavity opening. The trundle body can be comprised of two halves that are mounted about the elliptical extension of the trundle ball.

The multiple track railroad system may include a suspension bridge having a dome-shaped structure supporting a deck holding a portion of the multiple track railroad system. The deck of the bridge may have at least two levels of multiple track railroad systems.

It is another feature of the present invention to provide an embodiment of a multiple track railroad system for use with two adjacent sets of parallel continuous tracks, with the tracks having a distance therebetween and each set of tracks including two continuous rails having a distance therebetween, wherein the railroad system includes an engine for pulling a train, wherein the engine has a set of wheels riding on at least two of the rails, the engine having a width equal to at least one set of the tracks; at least one rail car connected to and propelled by the engine, the rail car spanning and extending beyond the outer rails of both sets of tracks; and at least four car-trucks supporting the rail car, with two of the car-trucks on each of the sets of tracks, and each car-truck including at least four wheels, with two wheels each riding on opposing rails of a set of the tracks, and each of the car-trucks connected to a laterally positioned car-truck on the adjacent set of tracks. The laterally positioned car-trucks are connected by a coupling support mounted to and spanning between the laterally positioned trucks. The railroad system may further include a coupling yoke attached to each of the coupling supports that extends beyond the rail car to connect two or more rail cars together or to connect the rail car to the at least one engine.

The multiple track railroad system may also include two side-by-side engines pulling the rail car, with the coupling yoke connecting the rail car to the engines. The multiple track railroad system may further include a yoke transition member connected between the coupling yoke and couplings on the engine. The yoke transition member can have a Y configuration, with fork ends of the Y being connected to respective couplings on the engine and a base portion of the Y connected to the coupling yoke on the rail car.

The multiple track railroad system may include a bridge having a dome-shaped structure supporting a deck holding a portion of the multiple track railroad system. The bridge may be a suspension-type bridge.

It is also a feature of the present invention to provide an embodiment of a multiple track railroad system for use with two adjacent sets of parallel continuous tracks, with the tracks having a distance therebetween and each set of tracks including two continuous rails having a distance therebetween, wherein the system includes an engine for pulling a train, and the engine has a set of wheels riding on at least two of the rails, and the engine has a width equal to at least one set of the tracks; at least one rail car connected to and propelled by the engine, the rail car spanning and extending beyond the outer rails of both sets of tracks, the rail car including at least one cantilever support attached to and extending below the floor of the rail car to a point beyond the outer rails of the tracks; and at least four car-trucks supporting the rail car, with two of the car-trucks on each of the set of tracks, each car-truck having at least four wheels, with two wheels each riding on opposing rails of a set of the tracks, and each of the car-trucks connected to a laterally positioned car-truck on the adjacent set of tracks, the laterally positioned car-trucks connected by a coupling support mounted to and spanning between the laterally positioned trucks.

The cantilever support may extend to a lowest point that is farthest from the rail car floor at the approximate middle of the rail car. The cantilever support may extend to a distance approximately equal to the middle of the wheels on the car-trucks.

The multiple track railroad system may also include arched openings in the cantilever support. The multiple track railroad system may further include a plurality of cantilever supports on each rail car, with the cantilever supports positioned between and beyond the car-trucks.

The multiple track railroad system may include a bridge having a dome-shaped structure supporting a deck holding a portion of the multiple track railroad system. The deck of the bridge may have at least two levels of multiple track railroad systems.

It is another feature of the invention to provide an embodiment of a bridge structure that includes a bridge deck; a dome-shaped structure located substantially above the deck; at least two dome supports on each side of the bridge deck supporting the dome-shaped structure; and a foundation, wherein the dome supports are anchored.

The deck of the bridge may include at least one set of tracks for a multiple track railroad system. The deck may have at least two levels and traffic may be conveyed on each of the levels.

The bridge may include suspension cables for suspending the bridge deck from the dome-shaped structure. The cables may be connected to the dome-shaped structure. The cables may also be mounted to a cross member supported by the dome-shaped structure.

The dome-shaped structure may have a substantially semi-spherical configuration. The dome-shaped structure may also have an arched configuration.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
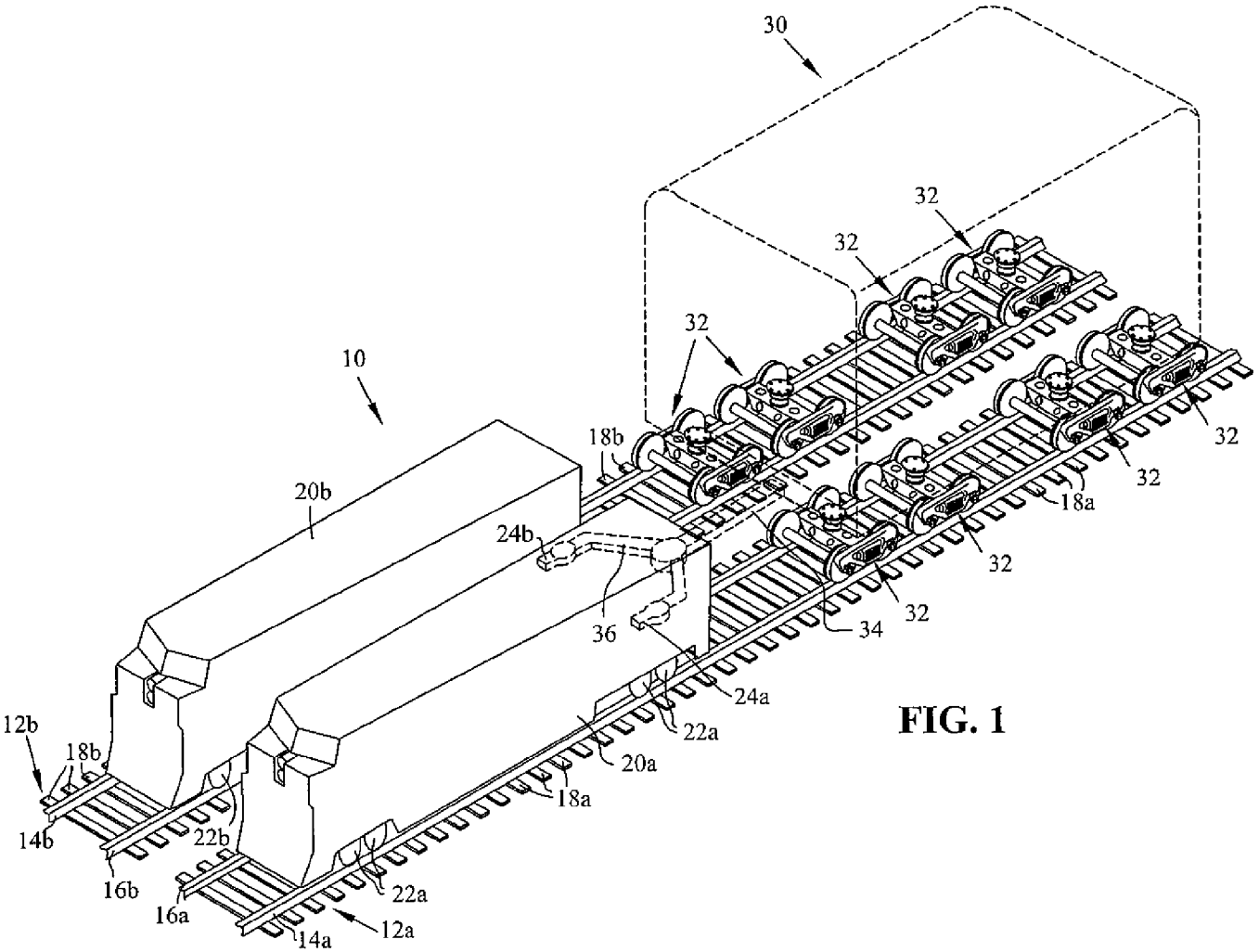
FIG. 1 is a perspective view of one embodiment of a multiple track railroad system of the present invention showing side-by-side locomotive engines in outline form pulling a double track width box car, also shown in outline form and having eight sets of car-trucks.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 2:
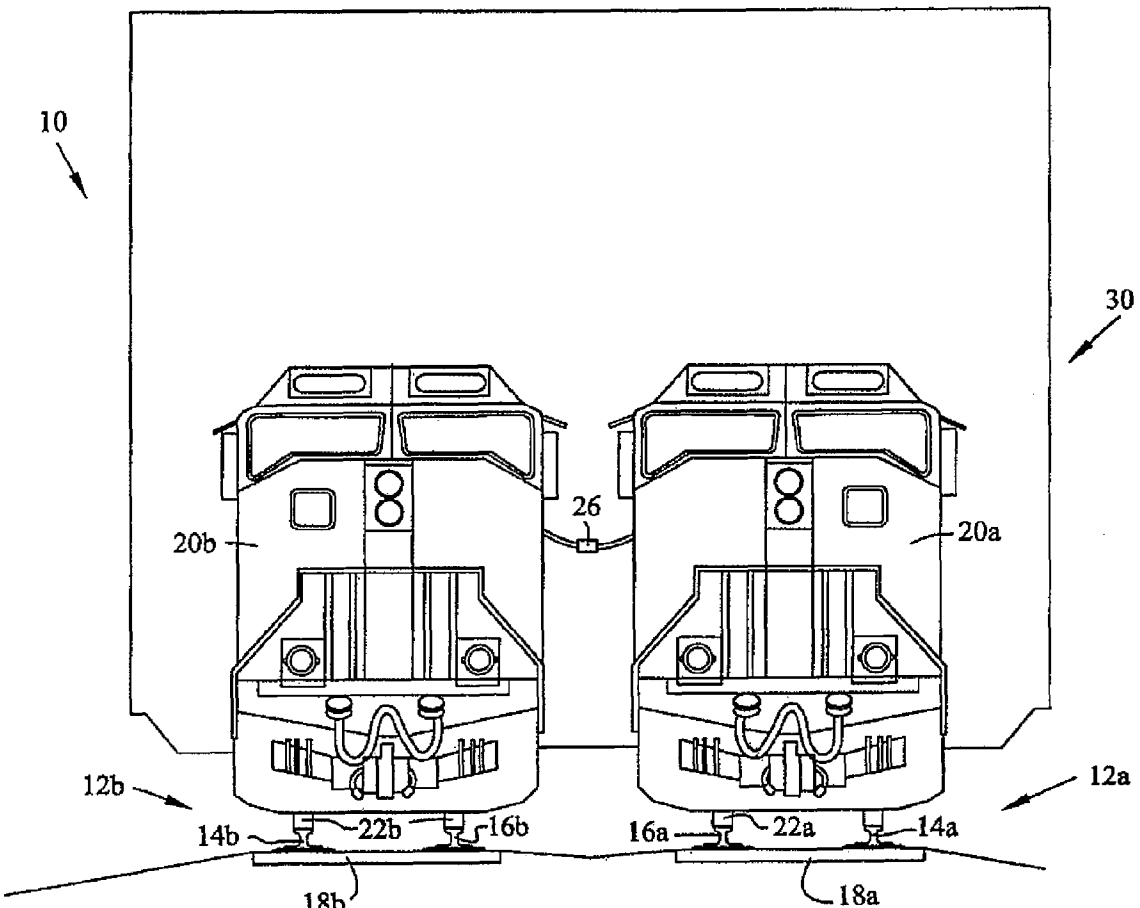
FIG. 2 is a front view of the multiple track railroad system of FIG. 1, with the box car in outline form.

Referring now to FIGS. 1 and 2, a multiple track railroad system, which may be referred to with the trademark "Train 21," is generally indicated as 10. In this embodiment, multiple track railroad system 10 includes two adjacent sets of parallel continuous tracks, generally indicated as 12*a* and 12*b*. Each set of tracks, 12*a*, 12*b*, includes two outer rails 14*a* and 14*b* and inner rails 16*a* and 16*b*, respectively. Interconnecting rails 14*a* to 16*a* and 14*b* to 16*b* are a plurality of ties 18*a*, 18*b*, respectively. The rails are mounted to the ties using rail spikes or other known techniques.

Multiple track railroad system 10 also includes a pair of engines 20*a* and 20*b*. Engine 20*a* has wheels 22*a* that are set upon and roll upon track 12*a*, and engine 20*b* has wheels 22*b* that are set upon and roll upon track 12*b*. Engines 20*a* and 20*b* are placed adjacent to one another and may have synchronous controls so that the speeds of the engines can be coordinated. Synchronization of the engines may be accomplished by using a connection, such as a coaxial cable 26 (FIG. 2), which may be strung across the space between the sets of rails 12*a* and 12*b* from side-by-side engines 20*a* and 20*b*. Each engine 20*a*, 20*b* also includes a coupling 24*a*, 24*b*, respectively, as is known.

Engines 20*a*, 20*b* pull a box rail car or ark, generally indicated as 30. In one embodiment, the box cars are approximately 30 feet wide or three times wider than a standard 10-foot-wide box car. As best shown in FIG. 1, box car 30 is supported on and rides on both tracks 12*a* and 12*b*. Box car 30 is supported by car-trucks or dollies, generally indicated as 32. In this embodiment, box car 30 has eight car-trucks as opposed to two that are used on standard railroad cars. Box car 30 also includes a coupling yoke 34 to couple the box car to the engines. A yoke transition member 36 is placed in between and interconnects coupling yoke 34 to couplings 24*a*, 24*b* on engines 20*a* and 20*b*, respectively.

Figure 6:
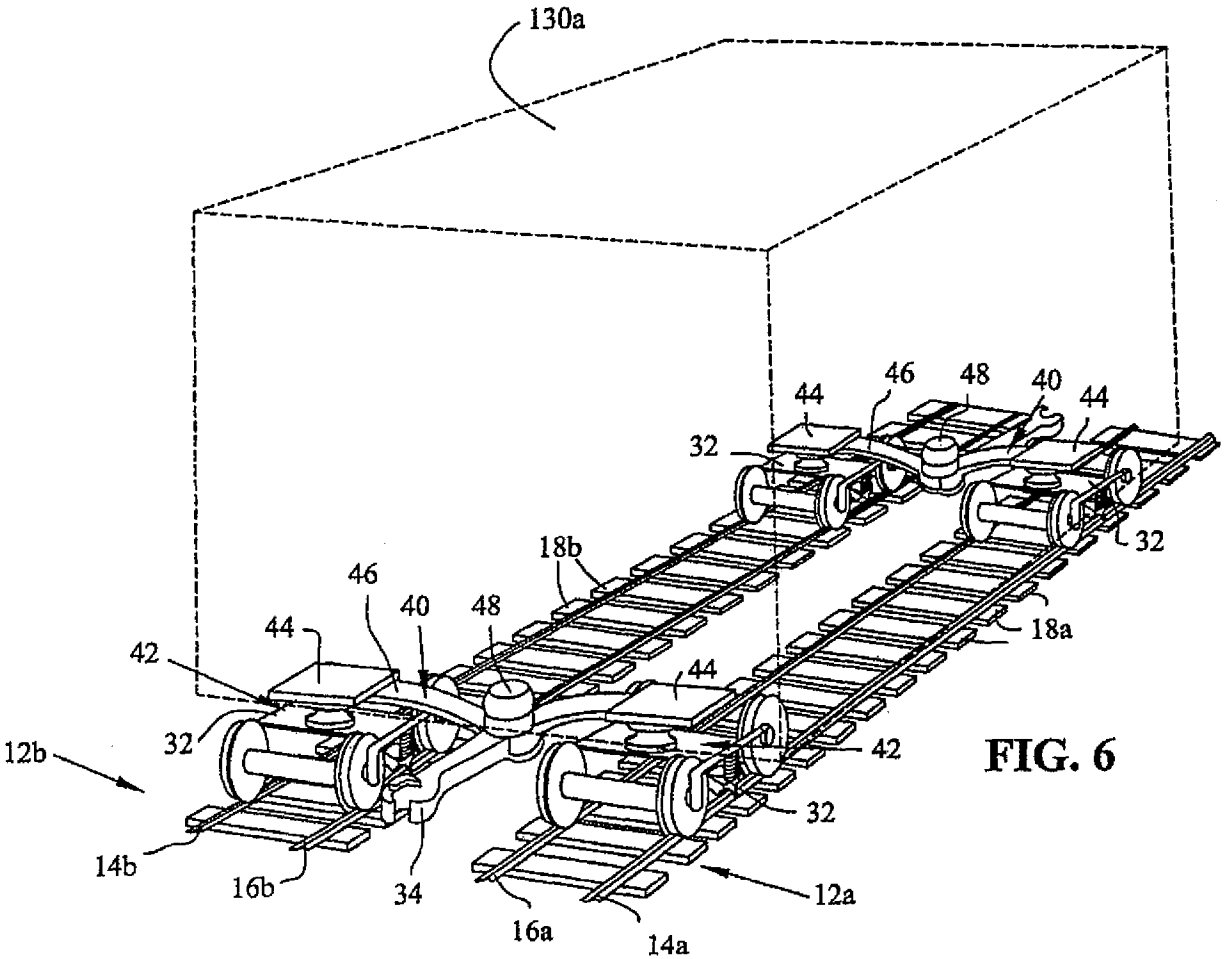
FIG. 6 is a perspective view of the box car of FIG. 5 shown in outline form and showing a coupling yoke and coupling supports.
Figure 7:
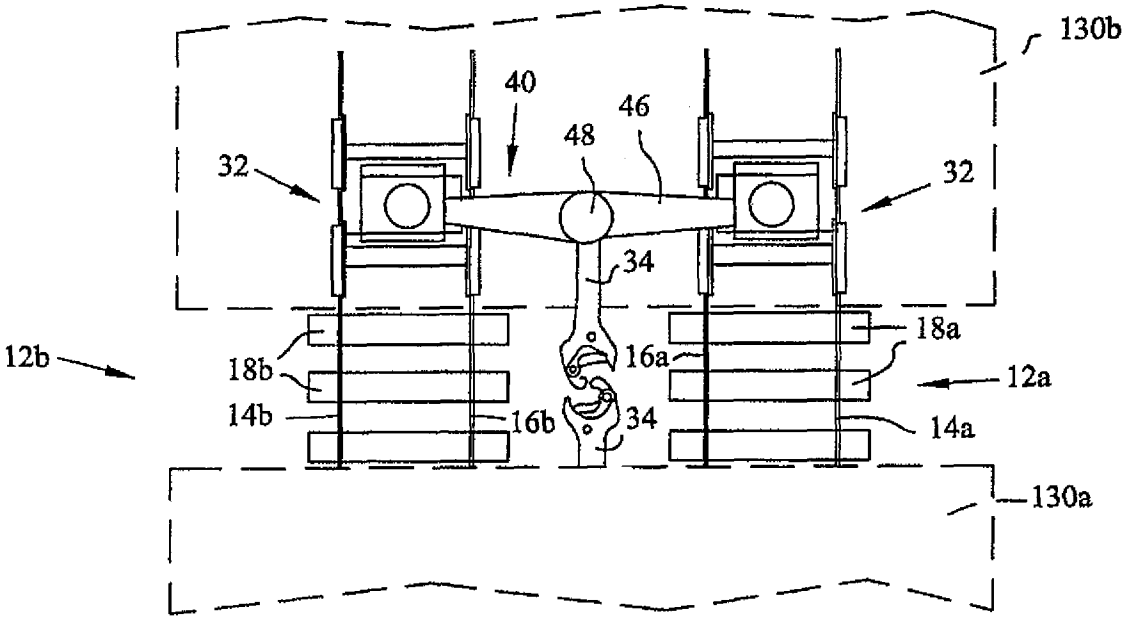
FIG. 7 is a partial top plan view of the box car of FIG. 6 shown in outline form and showing the coupling yoke ready to be coupled with a coupling yoke of an adjacent box car.

Now referring to FIGS. 6 and 10-14, car-trucks 32 and coupling yokes 34 will be discussed in further detail along with coupling supports, generally indicated as 40, and trundle carrier assemblies, generally indicated as 42. As best shown in FIG. 6, coupling supports 40 span adjacent car-trucks 32 that are riding on respective tracks 12*a* and 12*b* and also support coupling yokes 34. Each coupling support 40 includes a pair of mounting plates 44, a cross member 46 and a central portion 48. Mounting plates 44 are attached between the floor of the box car and trundle carrier assemblies 42. In the embodiment shown, mounting plates 44 are square, but rectangular, circular or other shapes may be used. Cross member 46 is attached to mounting plates 44 and may be made integral therewith or may be attached by welding, or with bolts or other known means. The cross members may be a beam, such as an I-beam, or may be cast or forged into structural support shapes, such as that shown in the embodiment of FIG. 6. In the embodiment of FIG. 6, coupling supports include a central portion 48, where coupling yoke 34 is pivotally mounted. It should be appreciated that such a pivotal connection allows the coupling yoke to pivot relative to the coupling support when the rail car is going around a bend or curve. When using eight car-trucks, as shown in the embodiment of box car 30 in FIG. 1, the coupling supports may just span each outer pair of adjacent car-trucks, or a single coupling support with four mounting plates or larger mounting plates spanning two or more car-trucks may be used for each group of four car-trucks in the front and back of the box car.

Figure 10:
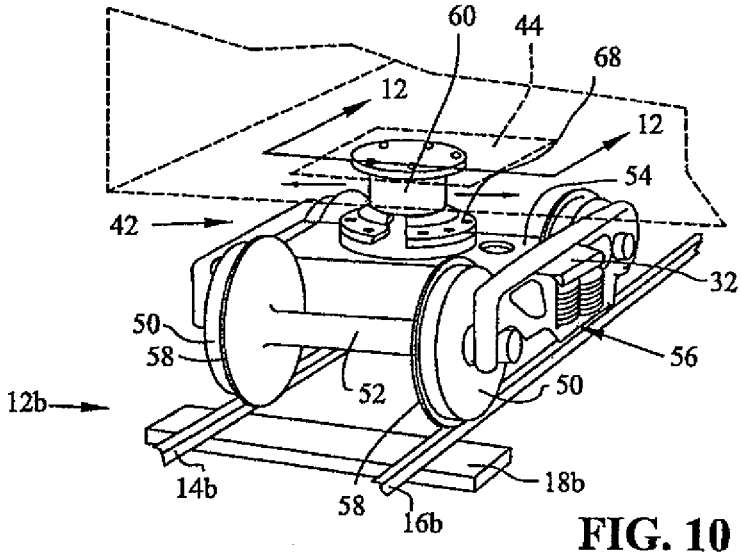
FIG. 10 is a perspective view of a trundle carrier assembly for use on the railroad cars of the present invention and mounted to a bolster on the car-trucks for allowing sideways and upward movement of the wheels relative to the railroad car body.
Figure 11:
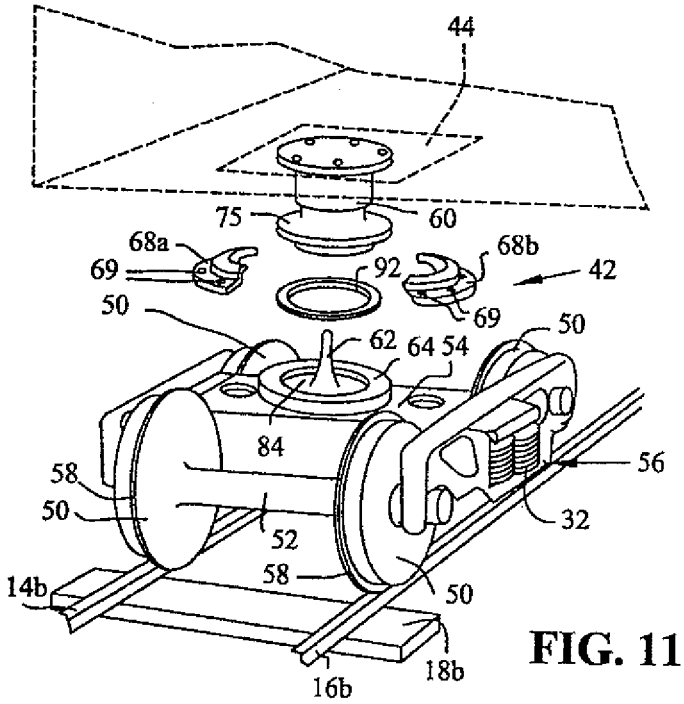
FIG. 11 is an exploded perspective view of the trundle carrier assembly of FIG. 10.
Figure 12:
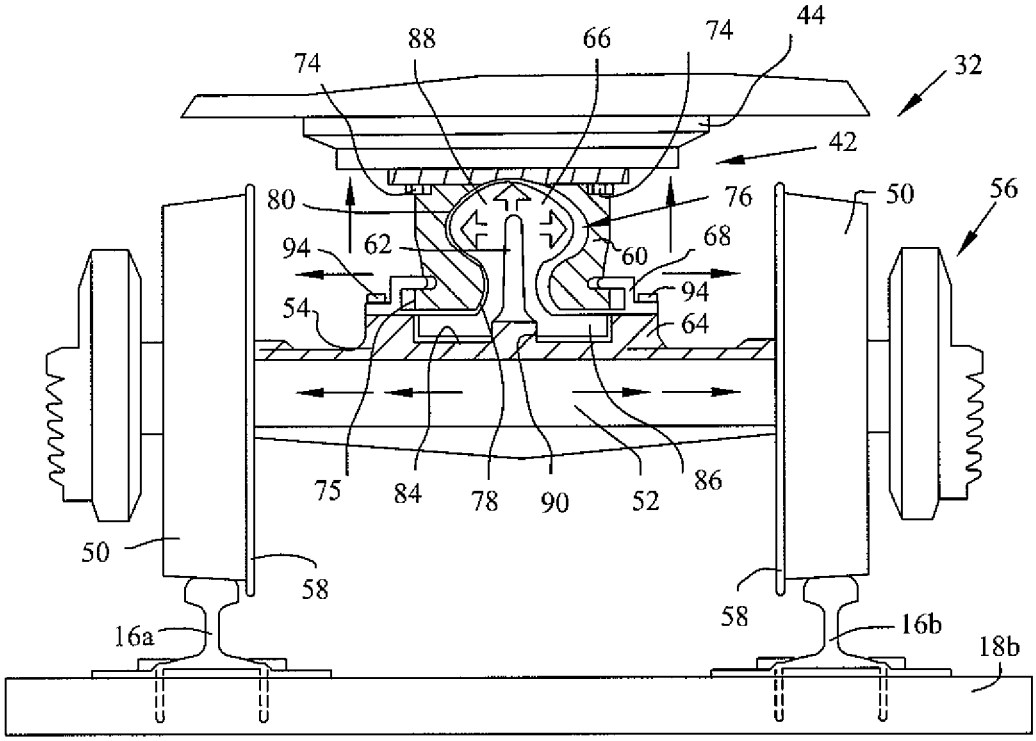
FIG. 12 is a cross-sectional view of the trundle carrier assembly of FIG. 10 taken along line 12-12 of FIG. 10.

Now referring to FIGS. 10-12, the car-trucks are of a design that is known and includes a set of four wheels 50, a pair of axles 52, a bolster 54, and a suspension assembly, generally indicated as 56. Each wheel 50 includes an inner rim portion 58, as is well known to keep the car-trucks from rolling off tracks 12*a* and 12*b*. The bolster can be any structurally suitable beam, casting or forging, and trundle carrier assemblies 42 are mounted thereto.

Figure 15:
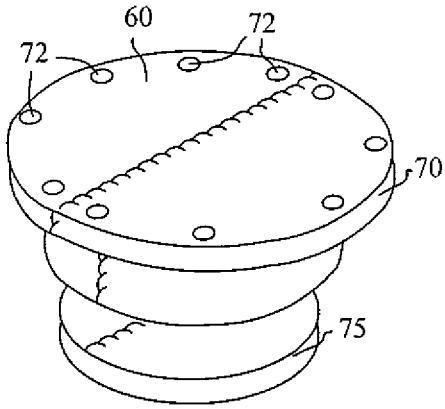
FIG. 15 is a perspective view of the trundle body halves and elliptical trundle ball of FIG. 13 in assembled form.
Figure 13:
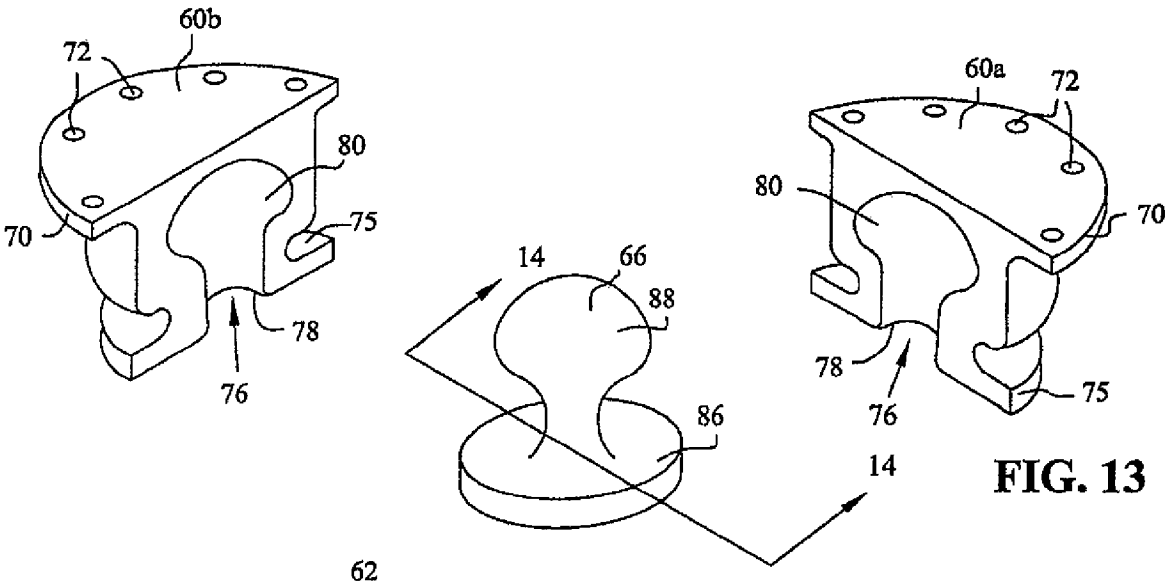
FIG. 13 is an exploded perspective view of two trundle body halves and an elliptical trundle ball for the trundle carrier assembly of FIG. 10.

Each trundle carrier assembly includes a trundle body 60, a trundle stud pin 62, a lower trundle socket 64, a trundle ball 66, and a lower mounting collar 68 having mounting holes 69. Trundle body 60 may be made from two half-portions 60*a*, 60*b* (FIG. 13) that may be welded or otherwise secured together, as shown in FIG. 15. Trundle body 60 includes an upper mounting flange 70 that includes a plurality of bolt holes 72 for mounting the trundle carrier assembly to mounting plates 44/the floor of the rail car with bolts 74 (FIG. 12) and a lower mounting flange 75. Trundle body 42 also includes a cavity or socket, generally indicated as 76, having an opening 78 in the bottom thereof and an enlarged elliptical portion 80.

Lower trundle socket 64 is mounted to bolster 54 and trundle stud pin 62 may be integrally formed with the lower trundle socket or otherwise attached thereto and extend upward from a central portion thereof. A donut-shaped recess 84 is located in lower trundle socket 64 and extends around trundle stud pin 62.

Figure 14:
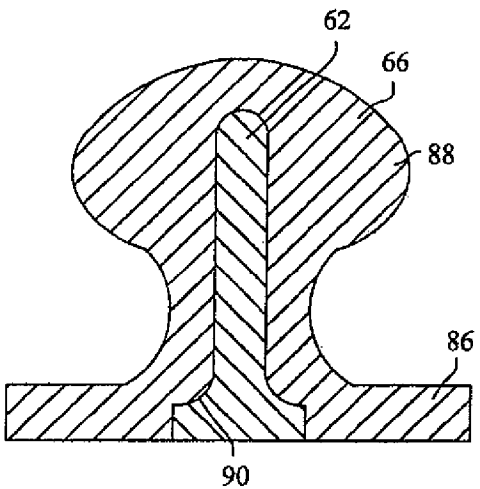
FIG. 14 is a cross-sectional view of the elliptical trundle ball of FIG. 13 taken along lines 14-14 of FIG. 13.

Trundle ball 42 includes a base flange portion 86 and an elliptical extension 88 that is configured to fit and move within elliptical portion 80 of socket 76 in trundle body 60, as will be described in greater detail below. Trundle ball 66 also includes a bore or recess 90 extending up into elliptical extension 88 from the bottom of base flange 86. It should be appreciated that bore 90 is configured to receive trundle stud pin 62, as is also further described in detail below. It should also be appreciated that base flange portion 86 of trundle ball 66 is configured and sized to be received in recess 84 of lower trundle socket 64, as best shown in FIG. 14.

Lower mounting collar 68 may be made in two pieces, 68*a*, 68*b*, as shown in FIG. 11 so that it may be fit around lower mounting flange 75 of trundle body 60 and a bushing ring 92 to rotatably secure the trundle body to lower trundle socket 64 with bolts 94 inserted through mounting holes 69. As should be appreciated, this mounting arrangement allows lower trundle socket 64 and car-trucks 32 to pivot or rotate on tracks 12*a*, 12*b* relative to the rail car to which trundle body 60 is attached.

In assembling car-trucks 32 and trundle carrier assemblies 42, the lower trundle socket 64 is mounted to the respective bolster 54 using bolts, welding or other known means of attachment. For trundle body 60, elliptical extension 88 of trundle ball 66 can be placed in the elliptical portion 80 of socket 76, and the two halves 60*a*, 60*b* of the trundle body then welded together so that trundle ball 66 is captured in socket 76. However, as elliptical extension 88 is smaller than elliptical portion 80, the trundle ball 66 can still move and rotate relative to trundle body 60; however, elliptical extension 88 will not fit through the opening 78 of socket 76, so that trundle body would have to be split again to remove the trundle ball. The trundle body can also be bolted to mounting plate 44 or the floor of the rail car using bolts 74. Bushing 92 is placed beneath lower mounting flange 75 of trundle body 60. Trundle body 60 can be attached to lower trundle socket 64 by fitting trundle stud pin 62 into bore 90 in trundle ball 66. In the embodiment shown, trundle stud pin 62 fits snugly into bore 90 of trundle ball 66.

Halves 68*a* and 68*b* of collar 68 may then be placed about lower mounting flange 75 of trundle body 60 and bolted to the lower trundle socket 64 with bolts 94 inserted through mounting holes 69 and into threaded holes (not shown) in the lower trundle socket. As noted above, this arrangement allows car-truck 32 to rotate or have slight vertical or horizontal movement relative to trundle body 60 and the attached rail car.

The train of multiple track railroad system 10 is assembled similar to standard trains with couplings 24*a* and 24*b* of engines 20*a* and 20*b* connected to yoke transition member 36, which in turn is coupled to coupling yoke 34 of rail car 30. The couplings are of a standard design, noting that the size of the members may be increased due to the additional weight that the multiple track railroad system will be hauling.

In one embodiment, as is common in the railroad industry, the distance between outer rails 14*a* and 14*b* is approximately 18'6", and the difference in the distance between inner rails 16*a* and 16*b* is 8'6", so that the distance between rails 14*a* to 16*a* and 14*b* to 16*b* for tracks 12*a* and 12*b* is approximately 5'. As discussed above, in one embodiment, rail car 30 is approximately 30' wide but may be less than 30' or increased to widths of 40' or more.

As the gross capacity and weight of the cars is greatly increased from standard railroad traffic, the railroad beds can be reinforced with a grout or cement that can be pumped or inserted into the subsoil beneath the tracks, similar to known reinforcing processes for use in lines that run over marsh and swampy lands. It should also be appreciated that the increased weight of the rail cars may require thicker/stronger rails than are normally used to support the multiple track railroad system. Appropriate standards can be established. The height of the rail cars for the multiple track railroad system can be set the same as current standards so that bridges and overpasses can be traversed with the multiple track railroad system; however, it should be appreciated that the wider base of the disclosed multiple track railroad system would provide stability at greater heights than standard railroads and that the height of the rail cars may be increased as infrastructure is replaced.

In operation, multiple track railroad system 10 operates for the most part like a standard railroad train. As mentioned above, however, the engines should be synchronized by use of coaxial cable 26 or other means to keep the engine speeds the same. Also, it should be appreciated that when traveling around a bend, the engine on the outer side of the bend may have to travel slightly faster than the inside engine due to the additional distance the engine on the outside of the curve travels. Such adjustments can also be made through the synchronizer.

In addition, as the multiple track train is traveling down the road, there may be slight variations of the distance between tracks 12*a* and 12*b* or the relative height thereof. Trundle carrier assembly as described above is designed to accommodate such variances without affecting the operation of the train. As best shown in FIG. 14, the clearance of elliptical extension 88 within the elliptical portion 80 of socket 76 in trundle body 60 will allow side-by-side cars on car-trucks 32 on tracks 12*a* and 12*b* to move horizontally sideways or vertically relative to one another so that trundle ball 66 will move in socket 76 of trundle body 60 to accommodate the relative movement of the car-trucks without affecting the stabilization of the rail car mounted thereto. With the disclosed design, the train wheels will align and track the rails. When encountering deviations in the tracks, the bolster transfers sideways thrust into the lower trundle socket knob through the trundle stud pin, wherein the stud pin forces the trundle elliptical ball to transfer the rail force and direction into the trundle ball. Socket 74 allows for the movement of elliptical extension 88, which maintains the overall train alignment. The elliptical shape of the trundle extension and socket forces the rail car to lift slightly and move sideways when following tracks of different heights or distance of separation. The side motion from rail track variations creates a self-centering characteristic and forces wheels 50 to track rails 14*a, b* and 16*a, b* and simultaneously keep the train in alignment.

It should also be appreciated that since the multiple track railroad system of the present invention utilizes both rails for a train traveling in a single direction, while the two tracks provided normally allow travel of two trains simultaneously in opposite directions, rail coordination will be required. Coordinated Universal Time (UTC) can be used to direct the train traffic without incident. For example, for the first 12 hours of the day, only rail traffic moving east and north may be allowed, whereas for the second 12 hours of the day, all traffic will be moving west and south. Additionally, the direction can also be alternated based upon even and odd days of the calendar.

Figure 3:
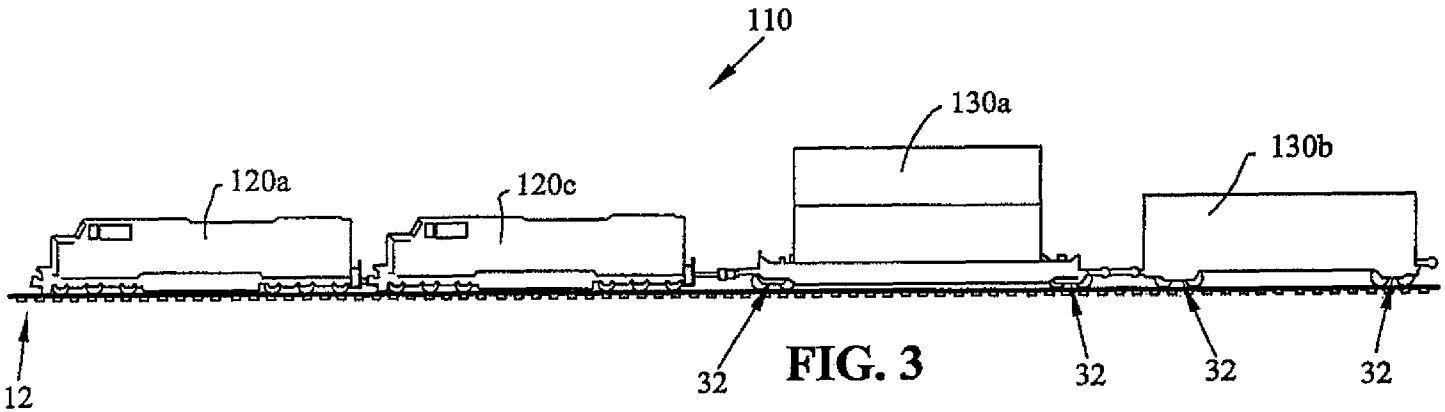
FIG. 3 is a side view of another embodiment of a multiple track railroad system of the present invention utilizing four locomotive engines and pulling box cars with four sets of car-trucks each.
Figure 4:
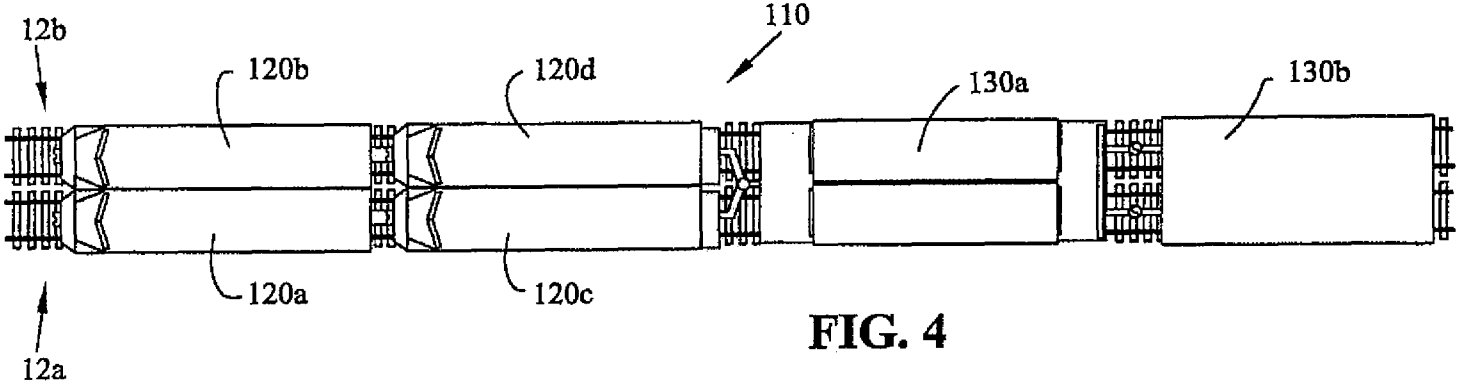
FIG. 4 is a top plan view of the multiple track railroad system of FIG. 3.

Now referring to FIGS. 3 and 4, another embodiment of the multiple track railroad system in accordance with the present invention is generally indicated as 110. Multiple track railroad system 110 can operate on two sets of parallel tracks, 12*a* and 12*b*, as embodiment 10; however, alternate embodiment multiple track railroad system 110 is shown with four engines, 120*a*, 120*b*, 120*c*, and 120*d*. Engines 120*a* and 120*b* are set side-by-side similar to engines 20*a* and 20*b* on respective tracks 12*a* and 12*b* and engines 120*c* and 120*d* set in a similar arrangement behind and connected to engines 120*a* and 120*b*. Engines 120*a-d* are also preferably synchronized, such as with coaxial cable 26 or other known means.

Figure 5:
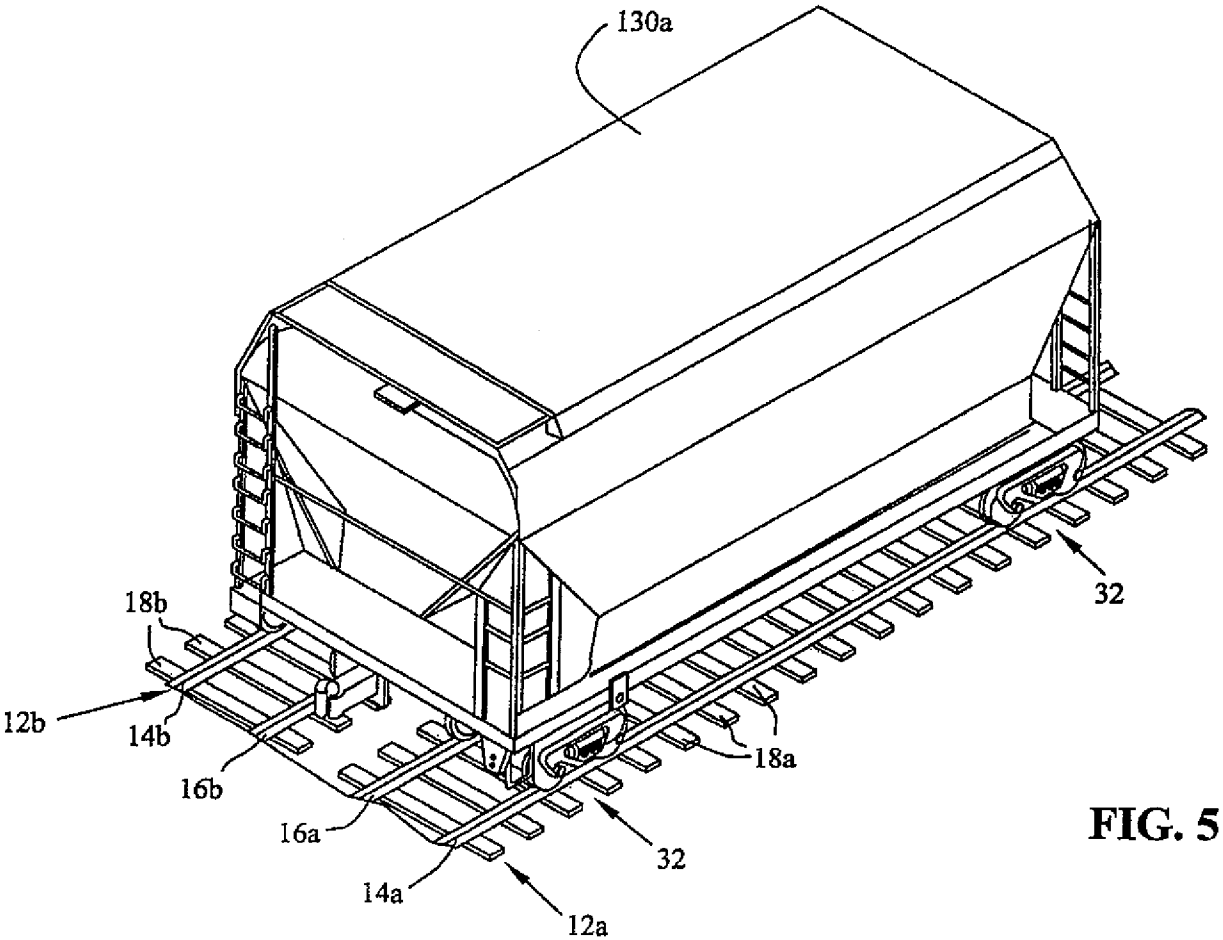
FIG. 5 is a perspective view of one of the box cars of the multiple track railroad system of FIG. 3.
Figure 8:
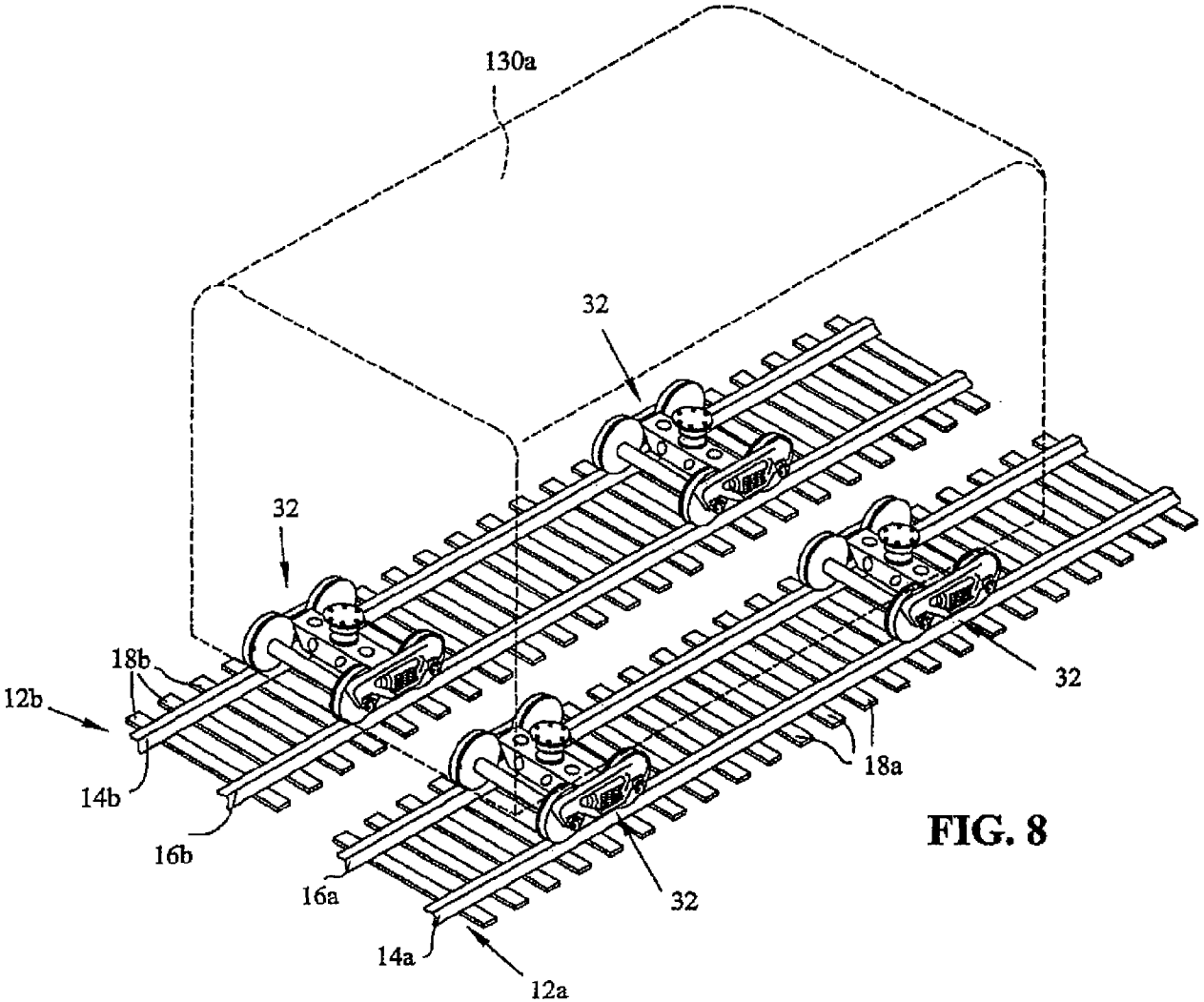
FIG. 8 is a perspective view of the box car of FIG. 5 shown in outline form with the coupling yoke and coupling supports removed.

Multiple track railroad system 110 also includes two or more railroad cars, 130*a* and 130*b*, which are set on a platform similar to rail car 30, except that rail cars 130*a* and 130*b* are shown with only four car-trucks 32 on each rail car, as best seen in FIGS. 5 and 8, as opposed to the eight car-trucks used on rail car 30.

Figure 9:
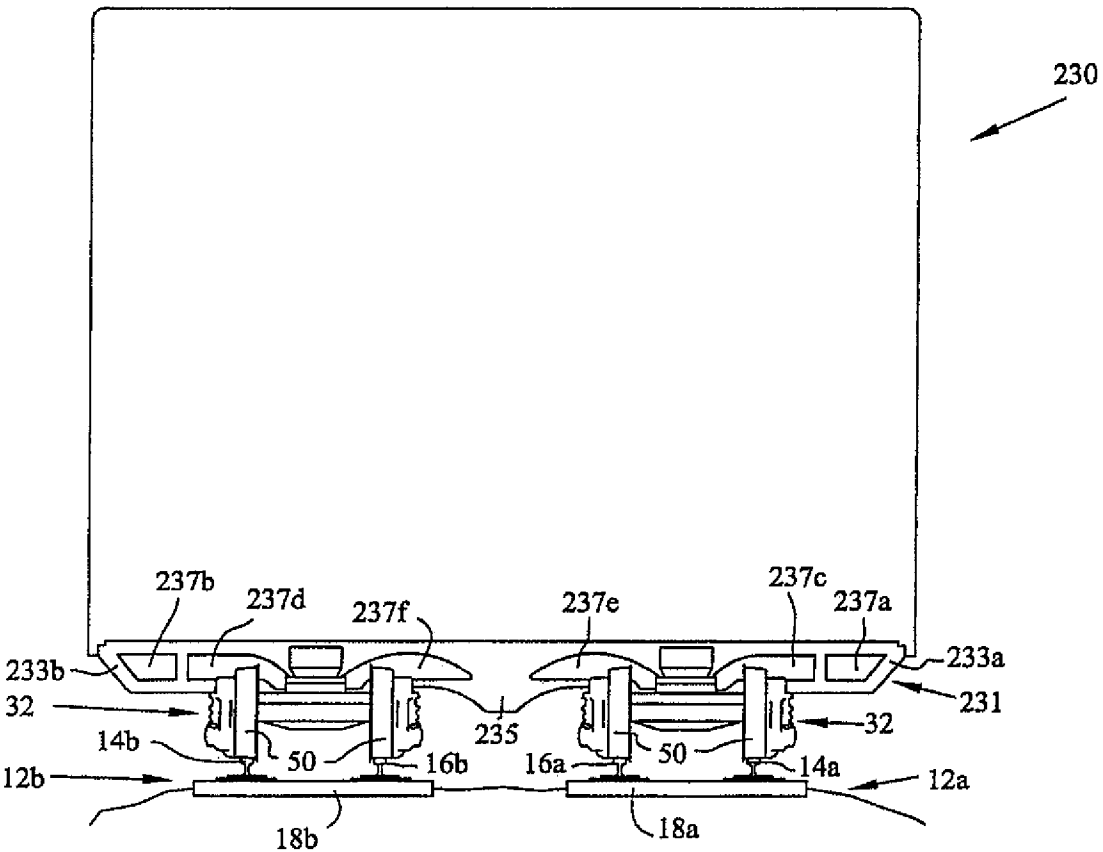
FIG. 9 is a front view of the box car of FIG. 5 shown in outline form with a car chassis cantilever support.

Now referring to FIG. 9, an alternate embodiment rail car is shown, generally indicated as 230. Rail car 230 is mounted on car-trucks 32 as the other embodiment rail cars. In addition, rail car 230 includes a cantilever support, generally indicated as 231, which extends below the bottom of the floor of the rail car. Cantilever support 231 has outer ends 233*a*, 233*b* that extend out beyond outer rails 14*a* and 14*b* of tracks 12*a* and 12*b*, respectively. Cantilever support 231 provides stability to rail car 230 and provides structural support for the large loads carried therein, which may be loaded in a position well outside of the car-truck supports. As should be appreciated, cantilever support 231 will also help support and stabilize loads that are off center in rail car 230. The lowest portion of cantilever support 231 is in a middle portion 235, which extends down approximately to the middle of wheels 50 in the embodiment shown. Cantilever support 231 also includes a number of openings 237*a-f*, and wherein openings 237*e* and 237*f* have an arched configuration in the embodiment shown. The number and placement of cantilever supports 231 may be varied along the bottom of the rail cars. For instance, the cantilever supports may be placed only between the car-trucks on a rail car. In addition, cantilever supports 231 may also be provided towards the ends of the rail cars to the outside of the car-trucks.

Figure 16:
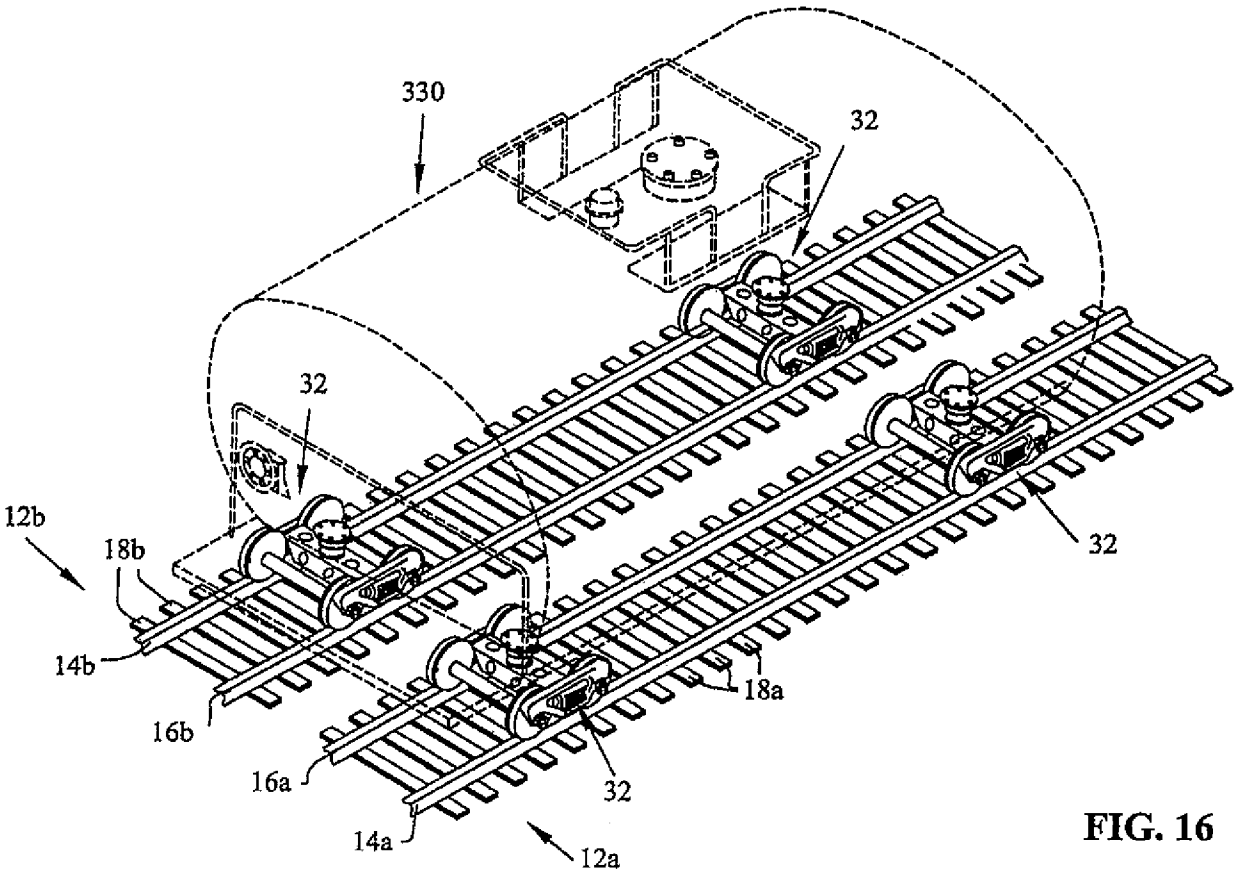
FIG. 16 is a perspective view of a multiple track railroad system tank car shown in outline form and having four car-trucks.

Now referring to FIG. 16, a tanker rail car, generally indicated as 330, is shown for use with the multiple track railroad systems of the present invention. Tanker rail car 330 may be mounted upon similar car-trucks 32, as other rail cars of the subject invention in an appropriate number to safely carry the weight of the car and contents. Four car-trucks are depicted in the embodiment shown.

Figure 17:
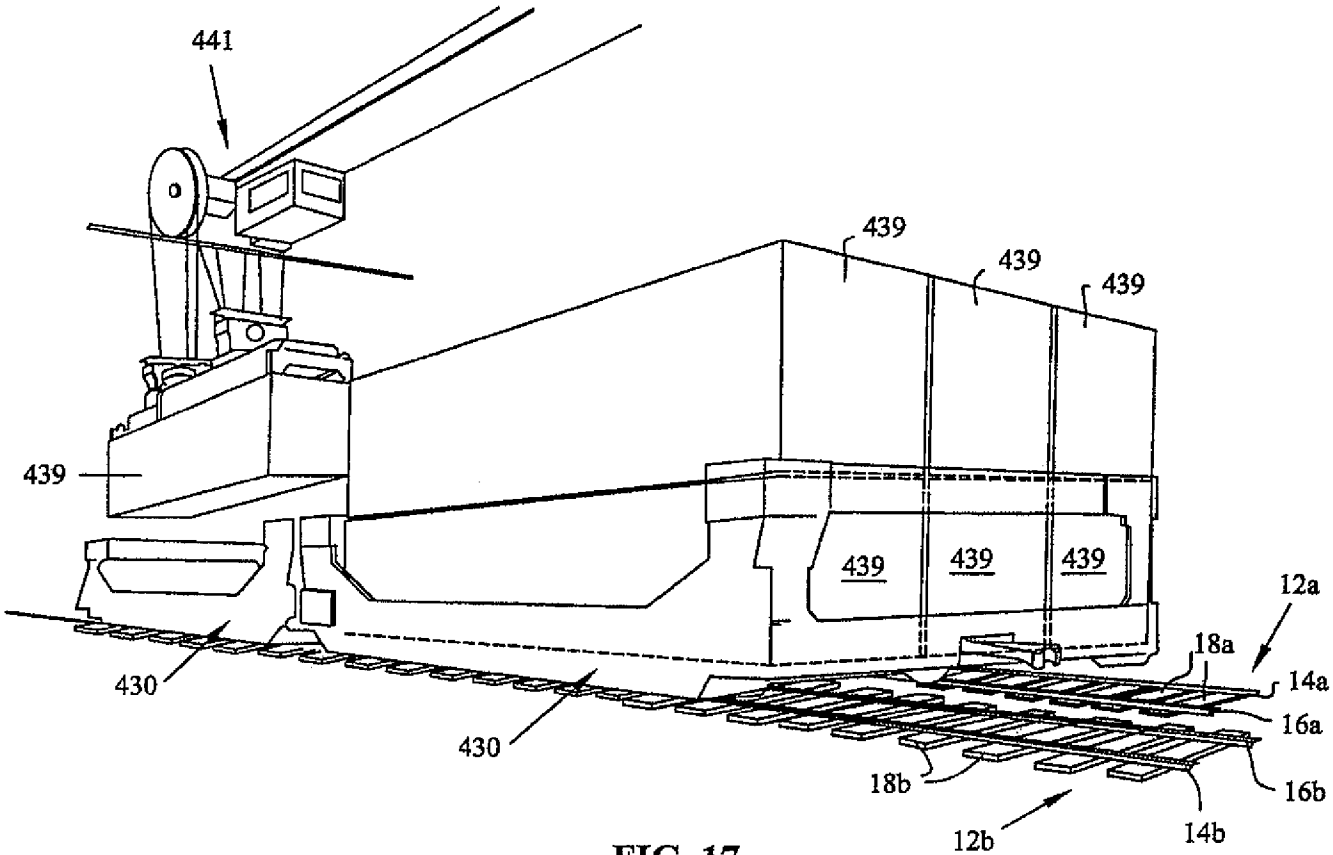
FIG. 17 is a perspective view of multiple track container cars for use with the multiple track railroad system of the present invention.
Figure 18:
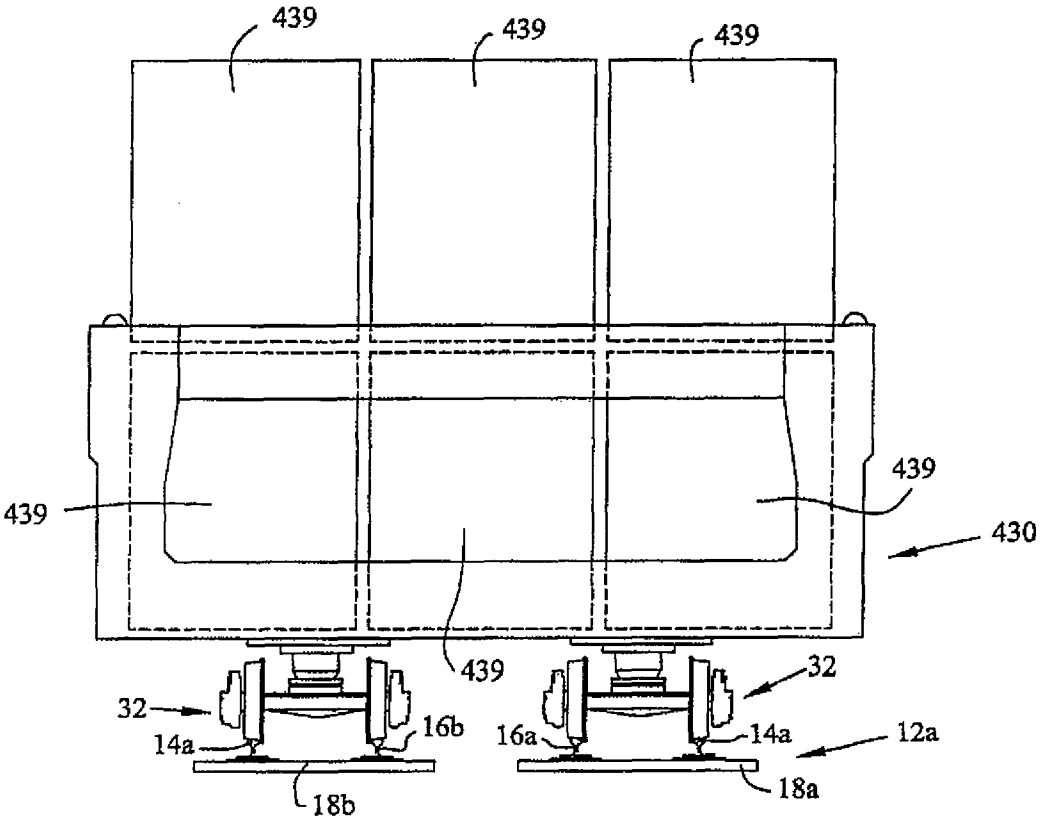
FIG. 18 is an end view of one of the multiple track container cars of FIG. 17 shown in outline form.

Now referring to FIGS. 17 and 18, flatbed rail cars, generally indicated as 430, are shown for use with the multiple track railroad systems of the subject invention. As can be seen, flatbed rail cars 430 can readily accommodate at least six standard-type shipping containers 439 in an embodiment where the flatbed rail cars 430 are 30' wide. Standard rail cars will typically only accommodate two of such containers. Containers may be mounted on rail cars using an overhead crane, generally indicated as 441, as is known.

Figure 19:
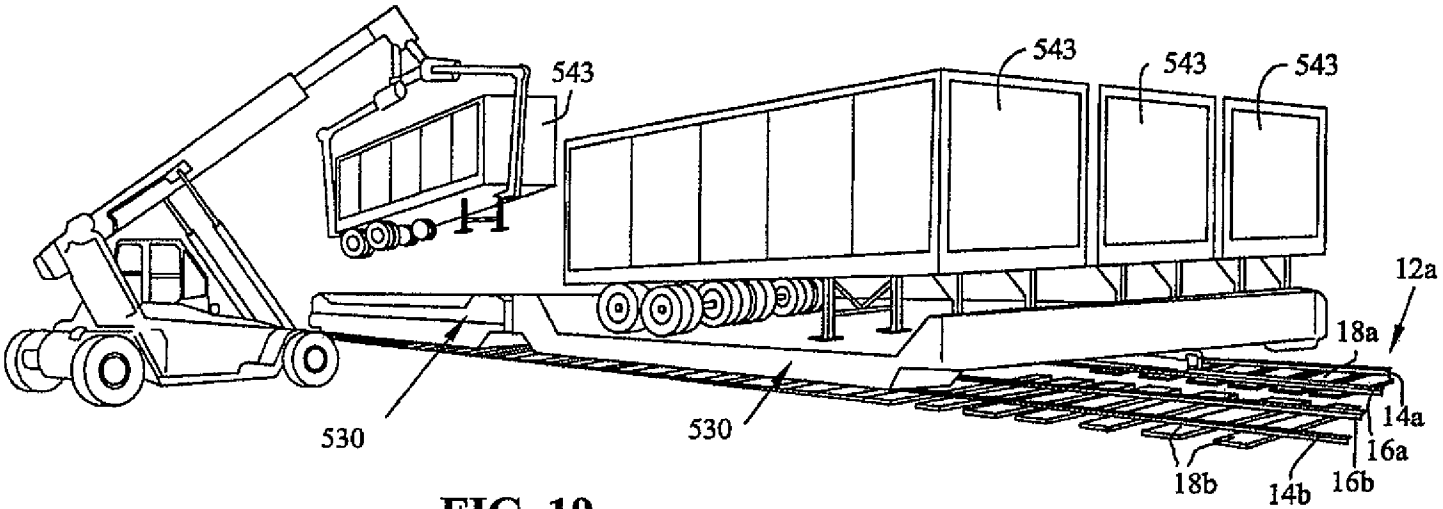
FIG. 19 is a perspective view of multiple track flatbed cars for use with the multiple track railroad system of the present invention.
Figure 20:
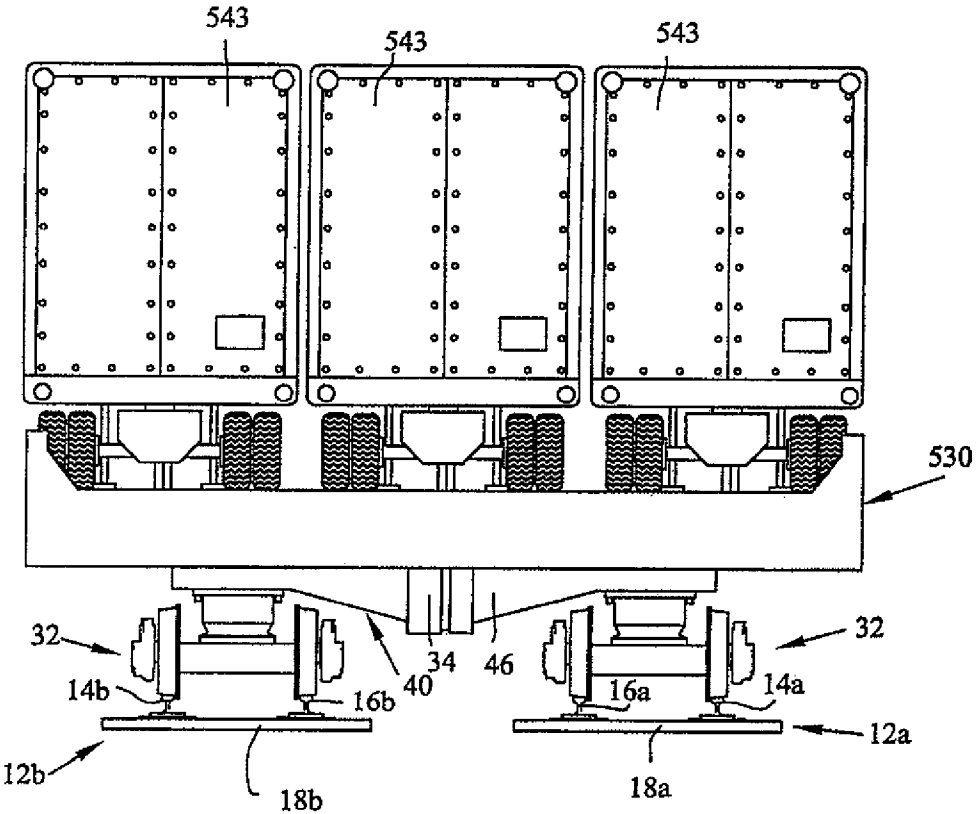
FIG. 20 is an end view of one of the multiple track flatbed cars of FIG. 19.

Now referring to FIGS. 19 and 20, another flatbed rail car, generally indicated as 530, is shown for transporting such items as semi-truck trailers 543. Flatbed rail cars 530 are also mounted on car-trucks 32, as disclosed above, and a 30' wide embodiment can hold three semi-truck trailers.

Figure 21:
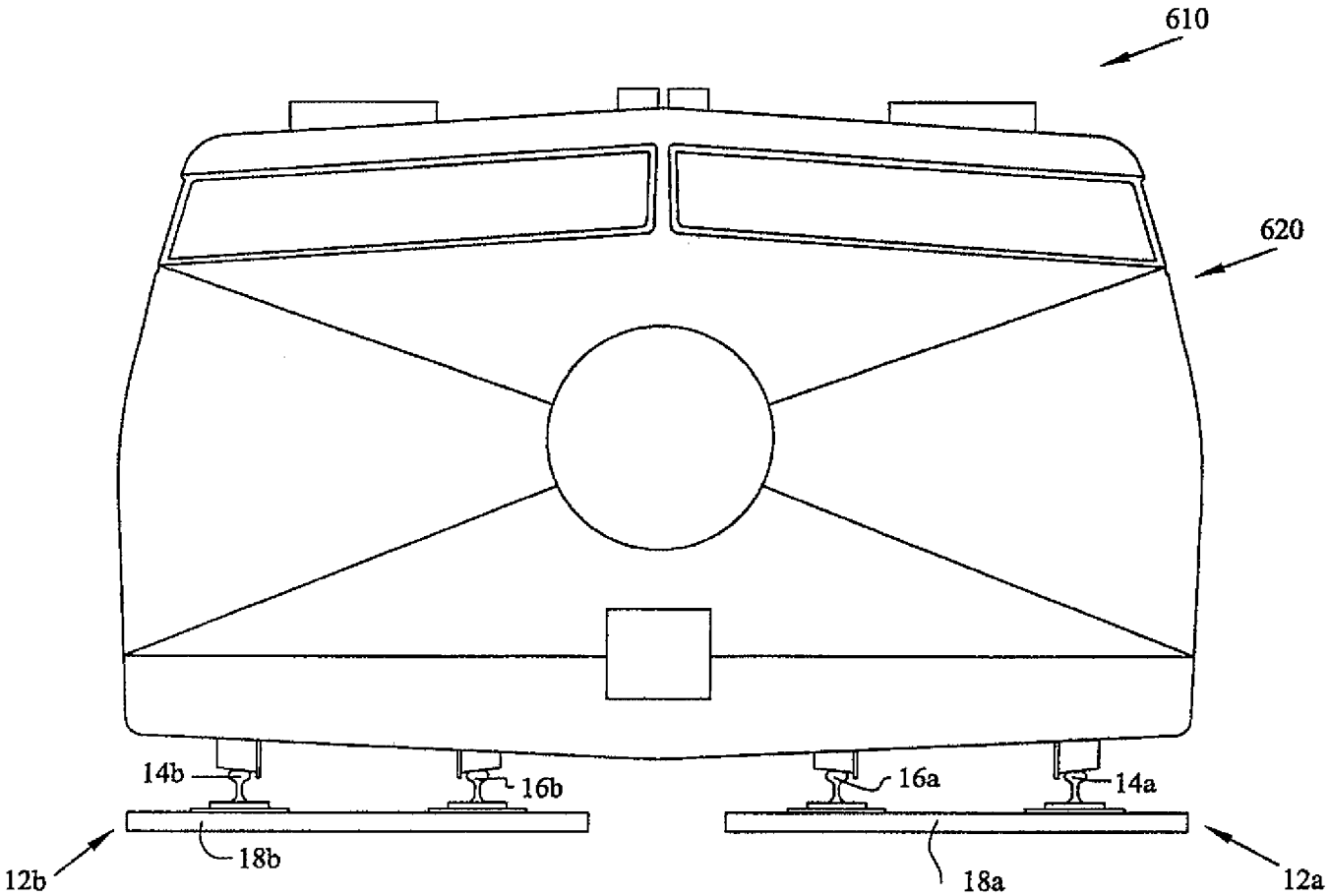
FIG. 21 is a front view of another embodiment of a multiple track railroad system of the present invention including a bullet-style train design.
Figure 22:
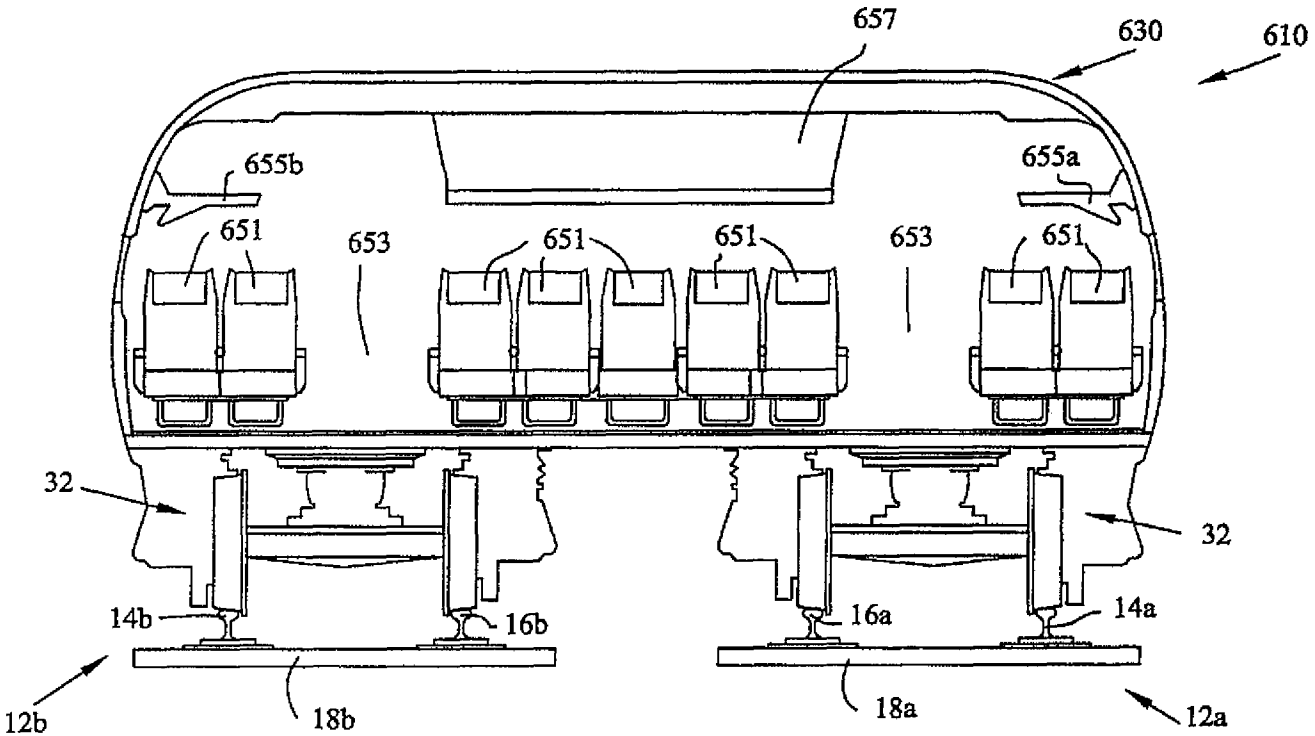
FIG. 22 is a cross-sectional view through a coach car of the bullet-style train of FIG. 21.

Now referring to FIGS. 21 and 22, an alternate embodiment of a multiple track railroad system is generally indicated as 610. Multiple track railroad system 610 utilizes one or more engines, generally indicated as 620, that span both sets of tracks 12*a* and 12*b* and ride on all of rails 14*a*, 14*b*, 16*a* and 16*b*. As shown in FIG. 22, multiple track railroad system 610 includes a passenger rail car, generally indicated as 630, which may also be used with the engines shown in the other embodiments. Passenger rail car 630 may be mounted on car-trucks 32 of the same as the other rail cars. In this embodiment, passenger rail car 630 includes nine wide comfortable passenger seats 651 across the width of the rail car and two substantial aisles 653. Passenger rail car 630 may also include overhead storage bins or shelves 655*a* and 655*b* along the sides thereof and a central luggage bin or shelf 657.

Figure 23:
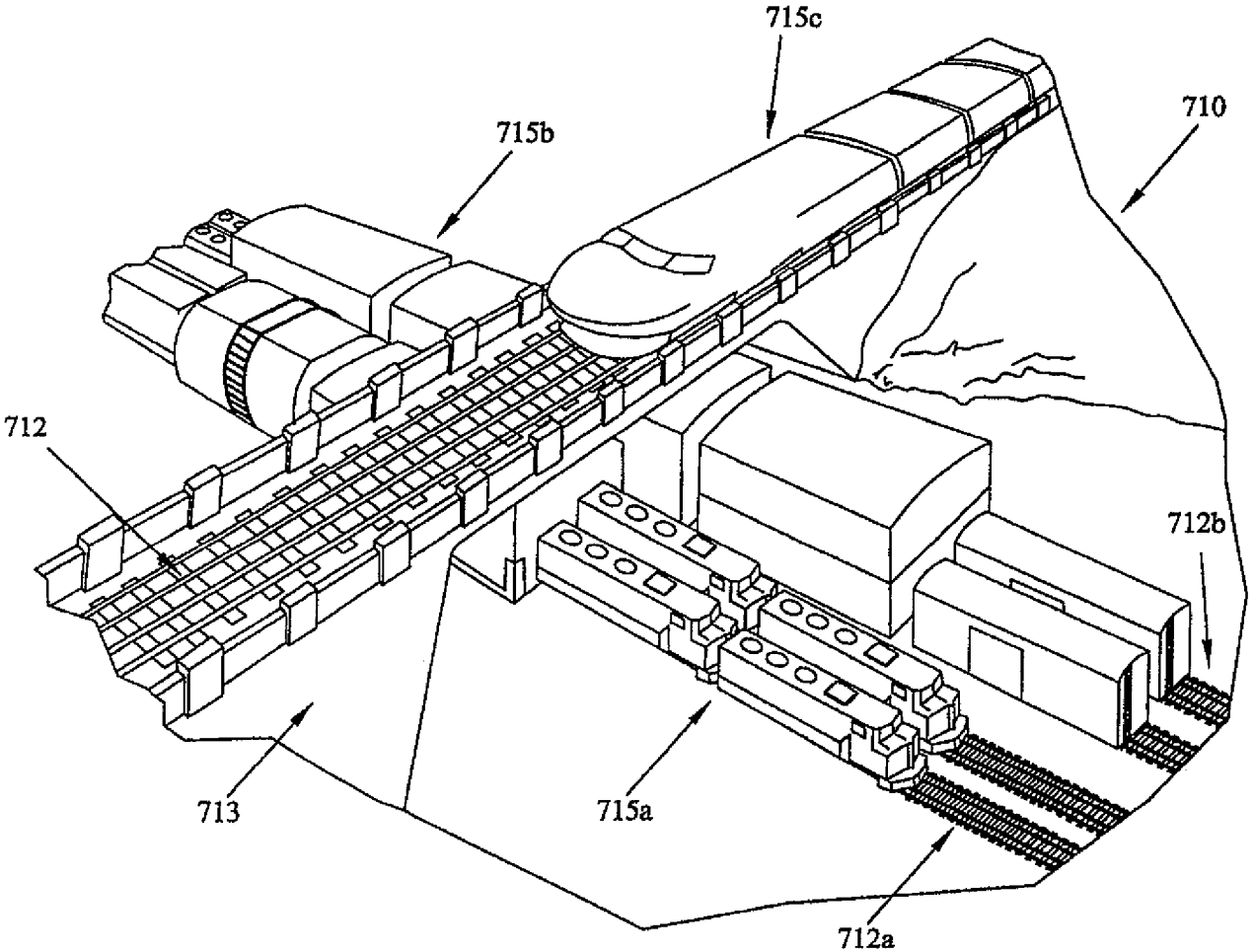
FIG. 23 is a perspective view of several embodiments of multiple track trains with two of the trains running side-by-side and one train passing overhead on a bridge.

Referring now to FIG. 23, another alternate embodiment of a multiple track railroad system is shown, generally indicated as 710. Multiple track railroad system 710 includes a mixture of the embodiments previously discussed and includes two sets of adjacent parallel tracks, generally indicated as 712*a* and 712*b*, and another set of parallel tracks, generally indicated as 712*c*, a portion of which is located on a bridge, generally indicated as 713, that extends above the sets of tracks 712*a* and 712*b*. Traveling on parallel tracks 712*a*, 712*b*, and 712*c* are multiple track trains, generally indicated as 715*a*, 715*b*, 715*c*, respectively.

Figure 24:
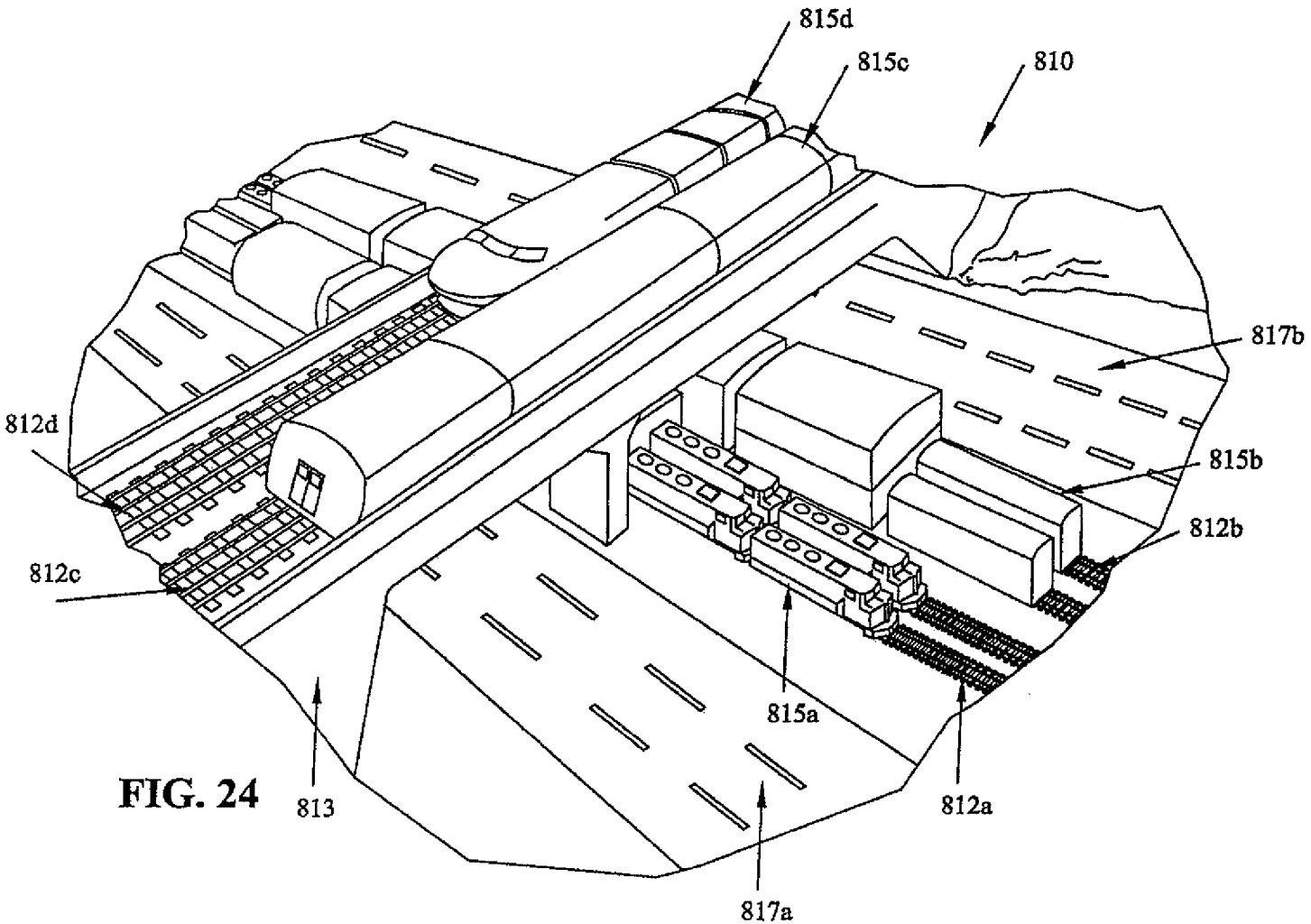
FIG. 24 is a perspective view of several embodiments of multiple track trains with two of the trains running side-by-side and two trains passing overhead on a bridge.

Yet another alternate embodiment of a multiple track railroad system is shown, generally indicated as 810, in FIG. 24. Multiple track railroad system 810 is similar to multiple track railroad system 710, but includes an additional set of tracks on the bridge. As such, railroad system 810 includes two sets of parallel tracks, 812*a* and 812*b* traveling beneath the bridge, and two additional parallel sets of tracks, 812*c* and 812*d*, a portion of which are mounted on the deck of a bridge, generally indicated as 813. Traveling on parallel tracks 812*a*-812*d* are multiple track trains, generally indicated as 815*a*, 815*b*, 815*c*, and 815*d*, respectively. Furthermore, straddling parallel track sets 812*a* and 812*b* are roadways, generally indicated as 817*a* and 817*b*, for conveying vehicular traffic (not shown). Roadways 817*a* and 817*b* traverse beneath bridge 813 as do parallel track sets 812*a* and 812*b*.

Figure 25:
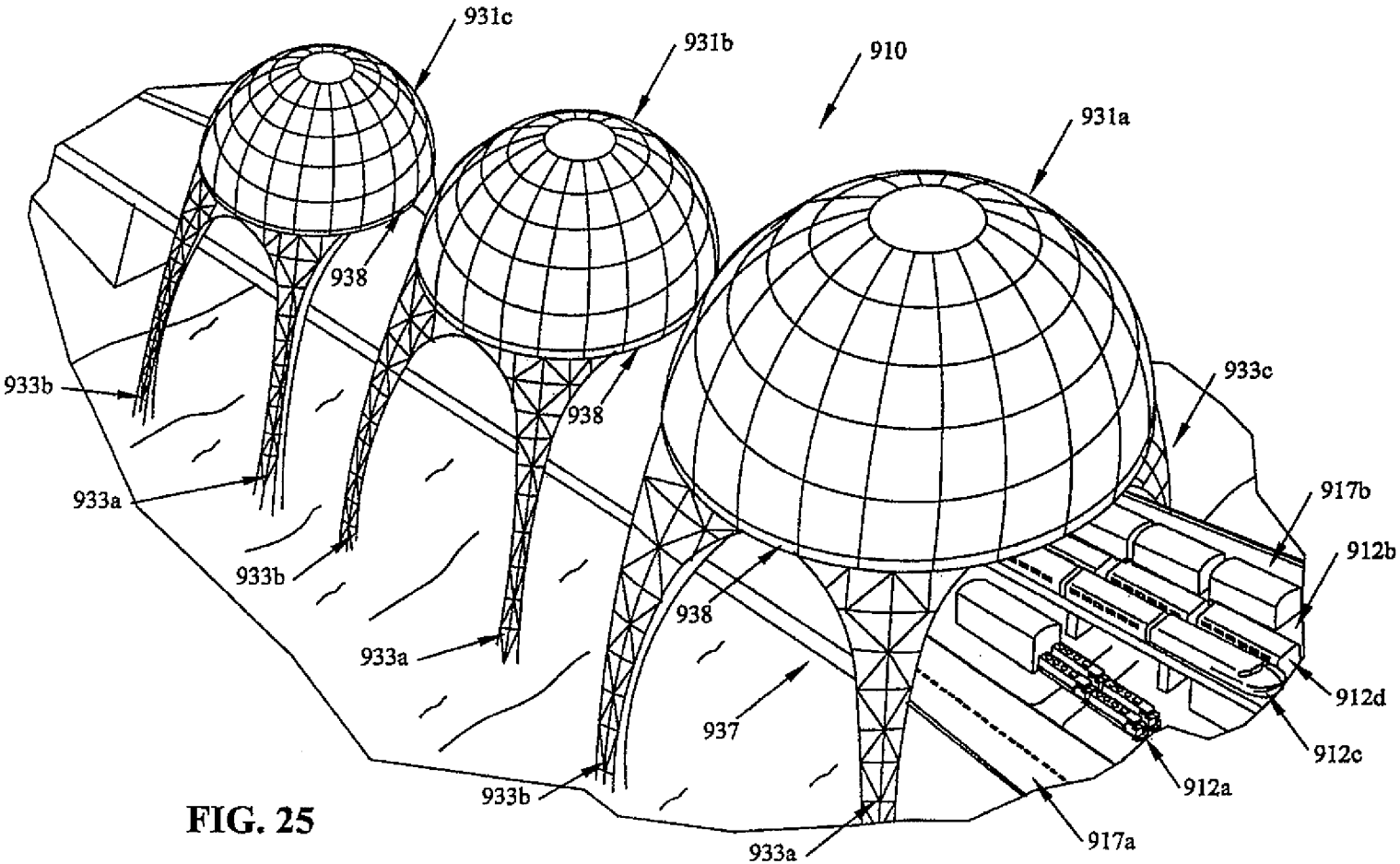
FIG. 25 is a perspective view of a bridge having dome-shaped structures for supporting a multiple track railroad system and a dual level deck.
Figure 26:
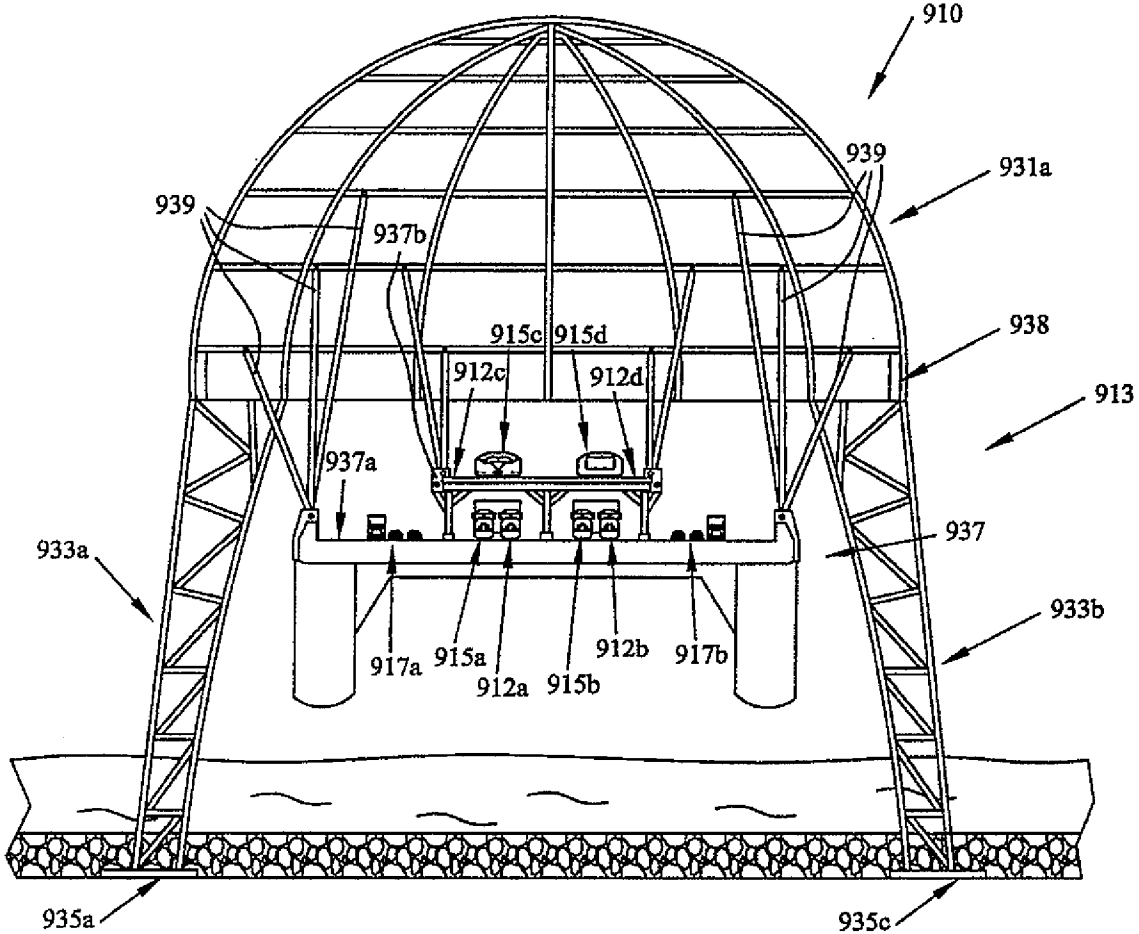
FIG. 26 is an end view of the bridge and one of the dome-shaped structures for the multiple track railroad system of FIG. 25 with the suspension cables supported from the framework of the dome-shaped structures.

Now referring to FIGS. 25 and 26, another alternate embodiment track railroad system is shown, generally indicated as 910. Multiple track railroad system 910 includes four sets of tracks, generally indicated as 912*a*, 912*b*, 912*c*, and 912*d*, all of which are mounted on the deck of a bridge, generally indicated as 913. Additionally, multiple track railroad system 910 includes multiple track trains 915*a*, 915*b*, 915*c*, and 915*d* traveling respectively on multiple track sets 912*a*-912*d*. Straddling multiple track sets 912*a* and 912*b* are roadways, generally indicated as 917*a* and 917*b*, respectively.

In the embodiment shown, bridge 913 is a suspension-type bridge and has a plurality of dome-shaped structures, generally indicated as 931*a*, 931*b*, and 931*c*. Bridge 913 also includes dome supports, generally indicated as 933*a*, 933*b*, 933*c*, and 933*d* (support 933*d* is similar to supports 933*a*-*c*; however, it is not visible in the views depicted), supporting each dome-shaped structure. At the base of each dome support 933*a*-933*d* is a foundation or piling 935*a*-935*d*, respectively, to which the dome supports are mounted. (Note that only foundations 935*a* and 935*c* are shown in FIG. 26.) Additionally, bridge 913 includes a deck structure, generally indicated as 937, on which a portion of the multiple set of tracks and railways are mounted.

In the embodiment shown, dome-shaped structures 931*a*-931*c* have generally semi-spherical configurations and are fabricated as a metal framework structure, using known fabrication methods and joining techniques. The structures may include composites of smaller truss-type structures and may include prefabricated modular assemblies or be fabricated on site. Additionally, each dome-shaped structure includes an annular frame section or ring adapter, generally indicated as 938, at the base of each semi-sphere to provide structural rigidity. Dome supports 933*a*-933*d* are also fabricated as metal frameworks or tower-like structures and, in the embodiment shown, are configured to form arch-shaped support configurations when attached to dome-shaped structures 931*a*-931*c*, as best shown in FIG. 25. Like the dome-shaped structures, the dome supports are also fabricated using known techniques and joining methods. Foundations 935*a*-935*d* are constructed using known foundation and structural techniques, and the dome supports are attached thereto using known techniques. In addition, if required, additional rigidity may be supplied to the foundations by adding connecting members (not shown) between the foundations or on the dome supports near the foundations. Such connecting members may have an arched or annular/partially annular configuration. It should also be appreciated that this design provides both a structurally interlocked geometric shape and clearance to facilitate the travel of vessels beneath the bridge. Additionally, the shape of the domes also provides an aesthetically pleasing look and resistance to wind and water forces.

Also, in the embodiment shown, bridge deck 937 includes a lower main deck, generally indicated as 937*a*, which supports track sets 912*a* and 912*b*, and an upper deck 937*b* on which track sets 912*c* and 912*d* are mounted. The bridge deck is supported by a plurality of cables 939, which are attached to the dome-shaped structure and the bridge deck for supporting the bridge deck over a span.

Figure 27:
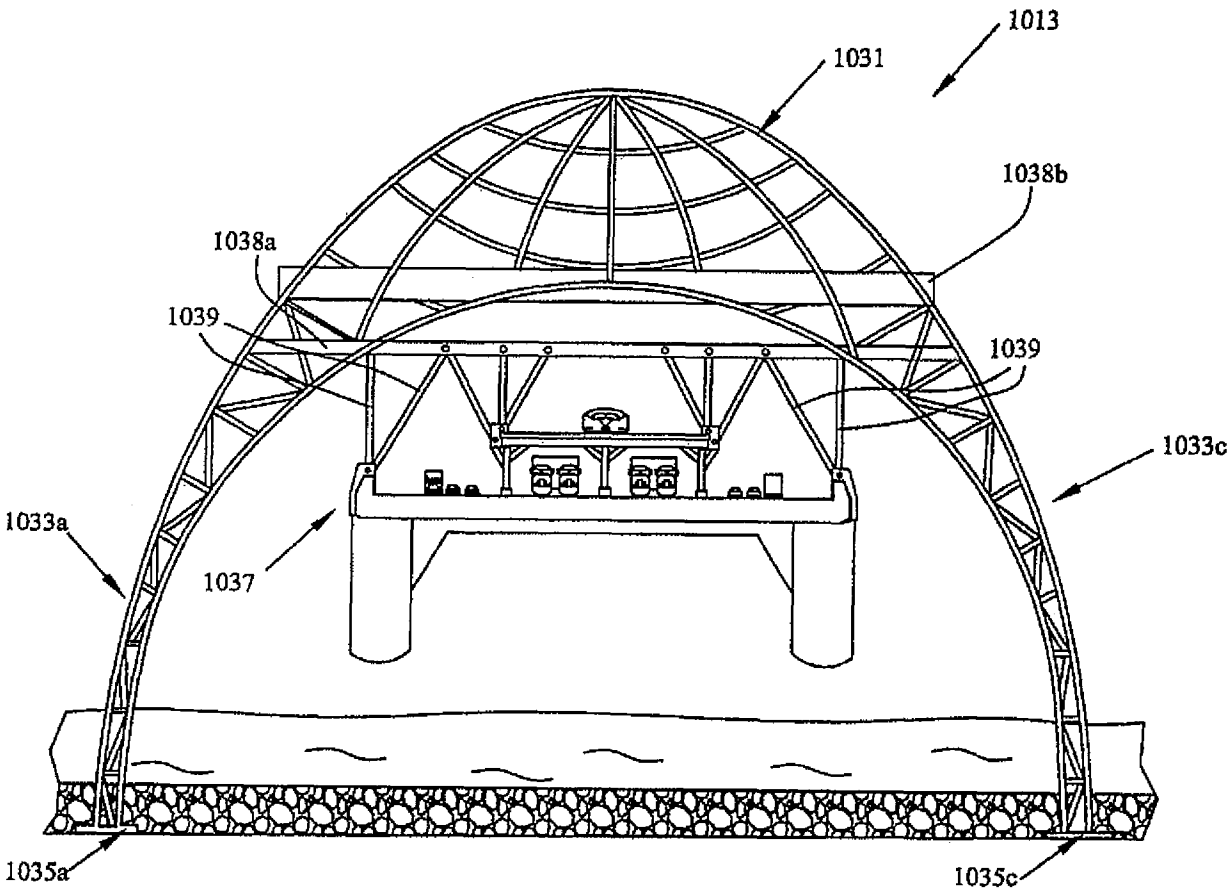
FIG. 27 is an end view of another embodiment of a suspension bridge having a dome- or arch-shaped structure and a multiple track railroad system with cables supported from a cross-frame member.

Now referring to FIG. 27, an alternate embodiment suspension bridge is shown, generally indicated as 1013. Suspension bridge 1013 includes a dome-shaped structure, generally indicated as 1031; dome supports, generally indicated as 1033*a*-1033*d* (only supports 1033*a* and 1033*c* are shown in FIG. 27); foundations, generally indicated as 1035*a*-1035*d* (only supports 1035*a* and 1035*c* are shown in FIG. 27); and a bridge deck, generally indicated as 1037. Dome-shaped structure 1031 is configured in an arched- or hyperbola-shaped configuration as compared to the semi-spherical dome shape of bridge 913. It should be appreciated that the terms "dome," "domed" or "dome-shaped" used in this application may refer to any spherical, semi-spherical, arched, hyperbolic, or other configurations that may fall under the classification of a dome.

Dome supports 1033*a*-1033*d* are similar to supports 933*a*-933*d* except that they are configured to maintain the general hyperbolic shape of dome-shaped structure 1031 as can be seen in FIG. 27. Dome-shaped structure 1031 and dome supports 1033*a*-1033*d* may be manufactured in a similar manner to that described above for bridge 913. Additionally, connecting foundation supports as discussed for bridge 913 may also be used.

Suspension bridge 1013 may also include cross-frame members 1038*a* and 1038*b*, which may be straight, curved, or annular in configuration. Suspension cables 1039 are connected between transverse frame structure 1038*a* in the embodiment shown and deck 1037, as opposed to connecting directly to the dome-shaped structure itself as shown for suspension bridge 913. It should be appreciated that cables may also be attached to transverse frame member 1038*b* or to both transverse frame members 1038*a* and 1038*b*. Additionally, the method of cable suspension shown for suspension bridge 913 and suspension bridge 1013 may be interchangeable.

While the invention has been taught with specific reference to these embodiments, one skilled in the art will recognize that changes can be made in form and detail without departing from the spirit and scope of the invention. For example, the number of car-trucks can be increased or varied depending upon the application. Also, although the embodiments have been shown using standard side-by-side track widths and spacing, it should be appreciated that specifically designed multiple tracks that may have more than two rails per track may be used and that the spacing may be set at another desired distance. The described embodiments are to be considered, therefore, in all respects only as illustrative and not restrictive. As such, the scope of the invention is indicated by the following claims rather than by the description.

The invention claimed is:

1. A multiple track railroad system for use with two adjacent sets of parallel continuous tracks with the tracks having a distance therebetween and each set of tracks including two continuous rails having a distance therebetween, said system comprising:

an engine for pulling a train, including a set of wheels riding on at least two of the rails, said engine having a width equal to at least one set of said tracks;

at least one rail car connected to and propelled by said engine, said rail car spanning and extending beyond the outer rails of both sets of tracks; and at least four car-trucks supporting said rail car, with two of said car-trucks on each of said set of tracks, each car-truck including at least four wheels, with two wheels each riding on opposing rails of a set of the tracks, and each of said car-trucks connected to a laterally positioned car-truck on the adjacent set of tracks, said laterally positioned car-trucks connected by a coupling support mounted to and spanning between said laterally positioned car-trucks, each of said coupling supports connecting only two adjacent laterally positioned car-trucks and not connected to car-trucks located on the same set of tracks, and further including a coupling yoke mounted directly to and extending from each of said coupling supports and extending beyond said rail car to connect two or more rail cars together or to connect said rail car to said at least one engine.

2. The multiple track railroad system as set forth in claim 1, including two side-by-side engines pulling said rail car, said coupling yoke connecting said rail car to said engines.

3. The multiple track railroad system as set forth in claim 2, further including a yoke arm connected between said coupling yoke and couplings on said engine.

4. The multiple track railroad system as set forth in claim 3, wherein said yoke arm has a Y configuration including two angled arm sections joined to a single arm section, with each angled arm section having a Y-shaped hook on the end, thereof.

5. The multiple track railroad system as set forth in claim 1, including a bridge having a dome-shaped structure supporting a deck holding a portion of the multiple track railroad system.

6. The multiple track railroad system as set forth in claim 5, wherein said bridge is a suspension-type bridge.

7. A multiple track railroad system for use with two adjacent sets of parallel continuous tracks with the tracks having a distance therebetween and each set of tracks including two continuous rails having a distance therebetween, said system comprising:

an engine for pulling a train, including a set of wheels riding on at least two of the rails, said engine having a width equal to at least one set of said tracks;

at least one rail car connected to and propelled by said engine, said rail car spanning and extending beyond the outer rails of both sets of tracks, said rail car including at least one cantilever support attached to and extending below the floor of said rail car to a point beyond the outer rails of said tracks, each of said cantilever supports being an isolated beam mounted perpendicular to a longitudinal axis of the railcar and extending downwardly from the rail car floor; and at least four car-trucks supporting said rail car, with two of said car-trucks on each of said set of tracks, each car-truck including at least four wheels, with two wheels each riding on opposing rails of a set of the tracks, and each of said car-trucks connected to a laterally positioned car-truck on the adjacent set of tracks, said laterally positioned car-trucks connected by a coupling support mounted to and spanning between said laterally positioned car-trucks, but not spanning between car-trucks on the same set of tracks.

8. The multiple track railroad system as set forth in claim 7, wherein said cantilever support extends to a lowest point farthest from the rail car floor at the approximate middle of said rail car.

9. The multiple track railroad system as set forth in claim 8, wherein said cantilever support extends to a position approximately equal to the middle of said wheels on said car-trucks.

10. The multiple track railroad system as set forth in claim 7, including arched openings in said cantilever support.

11. The multiple track railroad system as set forth in claim 7, including a plurality of cantilever supports on each rail car, said cantilever supports positioned between and beyond said car-trucks between the ends of said rail car and said car-trucks.

12. The multiple track railroad system as set forth in claim 7, including a suspension bridge having a dome-shaped structure supporting a deck holding a portion of the multiple track railroad system.

13. The multiple track railroad system as set forth in claim 12, wherein said deck of said bridge has at least two levels of multiple track railroad systems.

* * * * *